US007693437B2

(12) United States Patent
Hano et al.

(10) Patent No.: US 7,693,437 B2
(45) Date of Patent: Apr. 6, 2010

(54) IMAGE FORMING APPARATUS

(75) Inventors: Masami Hano, Abiko (JP); Takeshi Tomizawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 37 days.

(21) Appl. No.: 11/736,279

(22) Filed: Apr. 17, 2007

(65) Prior Publication Data

US 2007/0242967 A1 Oct. 18, 2007

(30) Foreign Application Priority Data

Apr. 18, 2006 (JP) ..... 2006/115049

(51) Int. Cl.

| | |
|---|---|
| ***G03G 15/00*** | (2006.01) |
| ***G03G 15/01*** | (2006.01) |
| ***G03G 15/02*** | (2006.01) |
| ***G03G 15/08*** | (2006.01) |
| ***G03G 15/20*** | (2006.01) |

(52) U.S. Cl. ..... 399/49; 399/314; 399/235; 399/169; 399/301

(58) Field of Classification Search ..... 399/49, 399/314, 296, 235, 187, 169, 301
See application file for complete search history.

(56) References Cited

U.S. PATENT DOCUMENTS

| | | | | |
|---|---|---|---|---|
| 5,072,244 | A | 12/1991 | Aoki et al. | 346/160 |
| 6,246,847 | B1 * | 6/2001 | Jeong et al. | 399/101 |
| 6,427,062 | B1 | 7/2002 | Takeuchi | 399/388 |
| 6,842,600 | B2 * | 1/2005 | Takayanagi | 399/296 |
| 6,990,300 | B2 | 1/2006 | Saito et al. | |
| 6,996,350 | B2 * | 2/2006 | Tomizawa | 399/66 |
| 2004/0005162 | A1 * | 1/2004 | Tomizawa | 399/66 |
| 2004/0062560 | A1 | 4/2004 | Mochizuki et al. | |
| 2004/0096232 | A1 * | 5/2004 | Ito et al. | 399/49 |
| 2005/0095042 | A1 * | 5/2005 | Takayanagi | 399/302 |
| 2005/0135822 | A1 * | 6/2005 | Nakagawa | 399/49 |
| 2005/0185988 | A1 * | 8/2005 | Mochimaru | 399/165 |
| 2005/0276620 | A1 | 12/2005 | Omata | 399/49 |
| 2006/0024076 | A1 * | 2/2006 | Kato et al. | 399/49 |

FOREIGN PATENT DOCUMENTS

| | | |
|---|---|---|
| JP | 1-142673 A | 5/1989 |
| JP | 5-297740 A | 11/1993 |

(Continued)

*Primary Examiner*—David M Gray
*Assistant Examiner*—Rodney Bonnette
(74) *Attorney, Agent, or Firm*—Fitzpatrick, Cella, Harper & Scinto

(57) ABSTRACT

An image forming apparatus includes an image bearing member having a photosensitive layer; toner image forming means for forming a detection toner image not to be formed on a recording material on the image bearing member; detecting means for optically detecting the detection toner image; control means for controlling a toner image forming condition of the toner image forming means on the basis of a result of detection of the detecting means; a transfer member for electrostatically transferring a toner image from the image bearing member onto a transfer material at a transfer region; constant voltage control means for providing a constant voltage applied to the transfer member; and voltage applying means for applying to the transfer member, when the detection toner image passes the transfer region, a predetermined voltage, controlled by the voltage control means, which has the same polarity as a charge polarity of toner.

8 Claims, 14 Drawing Sheets

FOREIGN PATENT DOCUMENTS

| | | | |
|---|---|---|---|
| JP | 2001-109205 | A | 4/2001 |
| JP | 2001-215859 | A | 8/2001 |
| JP | 2002-162805 | A | 6/2002 |
| JP | 2003-15484 | A | 1/2003 |
| JP | 2004-177437 | A | 6/2004 |
| JP | 2005-352041 | A | 12/2005 |
| JP | 2006-215369 | A | 8/2006 |

* cited by examiner

IMAGE FORMING APPARATUS

FIELD OF THE INVENTION AND RELATED ART

When optically sensing the image forming apparatus, a charged surface of the image bearing member and a density detecting toner image formed on the image bearing member are exposed. The exposure forms an electrostatic image on the image bearing member. The present invention relates to a control device which makes the trace of exposure insignificant.

The toner is made to stick to the electrostatic image formed on the surface of the photosensitive drum, it develops into the toner image, and the image forming apparatus which obtains the image by applying the voltage to the transferring member in the transfer area and transferring the toner image onto the transfer material is put in practical use.

The electrostatic image exposes the surface of the image bearing member in which the primary charging was carried out to the predetermined primary charged potential by the primary charger, and is formed.

In such the image forming apparatus, in order to accomplish the output image improvement, without spoiling the productivity, the density detecting toner image is formed on so-called the inter-sheet space on the photosensitive drum.

The density detecting toner image on the photosensitive drum is sensed by the optical sensor.

While the density detecting toner image formed on the photosensitive drum passes the transfer area, the voltage having the same polarity as the toner is applied to the transferring member and the toner deposition to the transfer material or the transferring member is prevented to it.

In the color image forming apparatus using the intermediary transfer member or the recording material carrying member, in addition to density detecting toner image, color registration detection toner image for the color-registrations may be formed into the period of the inter-sheet space on the above described photosensitive drum.

In this case, while the inter-sheet space passes the transfer area, the voltage having the polarity opposite to that of the toner is applied to the transferring member and the color registration detection toner image is transferred onto the intermediary transfer member or onto the recording material carrying member.

The density detecting toner image sensed on the photosensitive drum is also transferred onto the intermediary transfer member or the recording material carrying member with the color registration detection toner image.

The color registration detection toner image is sensed on the intermediary transfer member or the recording material carrying member and is fed back to the forming position on the photosensitive drum of each color toner image.

However, if the density detecting toner image on the photosensitive drum is irradiated with the detecting light of the optical sensor, the potential of the region which retains the density detecting toner image will become close to the grand level.

In other words, the difference between the potential of the region of the photosensitive drum which retains the density detecting toner image, and the primary charged potential is enlarged by exposing to the optical sensor.

In the following primary charging step, this potential difference is not eliminated but produces the image non-uniformity.

SUMMARY OF THE INVENTION

The principal object of the present invention is to provide an image forming apparatus which can reduce the influence to the image of the trace of exposure of the surface of the image bearing member by the optical sensor.

According to an aspect of the present invention, there is provided an image forming apparatus comprising toner image forming means for forming a toner image, said toner image forming means including an image bearing member having a photosensitive layer, a charger for charging said image bearing member, an exposure device for exposing said image bearing member to form an electrostatic image, and a developing device for developing the electrostatic image; a transfer member for electrostatically transferring a toner image from said image bearing member onto a recording material at a transfer region; detecting means for optically detecting a detection toner image formed on said image bearing member; control means for controlling a toner image forming condition of said toner image forming means on the basis of a result of detection of said detecting means; voltage applying means for applying to when said detection toner image passes the transfer region, a voltage which has the same polarity as a charge polarity of the toner image, wherein potential difference between the voltage and a potential of a region of said image bearing member charged by said charging means is less than a discharge threshold therebetween, and a potential difference between the voltage and a potential of a region of said image bearing member where the detection toner image is exposed to said detecting means is not less than the discharge threshold.

According to an aspect of the present invention, there is provided an image forming apparatus comprising an image bearing member for carrying a toner image; toner image forming means for forming a toner image, said toner image forming means including an image bearing member having a photosensitive layer, a charger for charging said image bearing member, an exposure device for exposing said image bearing member to form an electrostatic image, and a developing device for developing the electrostatic image, wherein said toner image forming means continuously forms toner images, and said toner image forming means forms a detection toner patch on a non-image region of said image bearing member; a first detecting means for optically detecting the detection toner patch on said image bearing member; a transfer member for being supplied with a transfer voltage to transfer the toner image on said image bearing member and the detection toner patch onto an intermediary transfer member; a second detecting member for detecting the detection toner patch transferred onto the intermediary transfer member from said image bearing member;

control means for controlling a toner image forming condition of said toner image forming means on the basis of results of detection of said first and second detecting means; voltage control means for controlling the transfer voltage so that absolute value of the transfer voltage when the detection toner patch detected by said first detecting member is transferred from said image bearing member onto the intermediary transfer member is smaller than an absolute value of the transfer voltage when the toner image detected by said second detecting member is transferred from said image bearing member onto the intermediary transfer member.

According to a further aspect of the present invention, there is provided an image forming apparatus comprising an image bearing member for carrying a toner image; toner image forming means for forming a toner image, said toner image forming means including an image bearing member having a photosensitive layer, a charger for charging said image bearing member, an exposure device for exposing said image bearing member to form an electrostatic image, and a developing device for developing the electrostatic image, wherein said toner image forming means continuously forms toner images, and said toner image forming means forms a detection toner patch on a non-image region of said image bearing member; first detecting means for optically detecting a detection toner patch on said image bearing member; a recording material carrying member for carrying a recording material; transfer member for being supplied with a transfer voltage to transfer a toner image from said image bearing member onto a recording material carried on said recording material carrying member and to transfer a detection toner patch from said image bearing member onto said recording material carrying member; a second detecting member for detecting the detection toner patch transferred onto said recording material carrying member from said image bearing member; control means for controlling a toner image forming condition of said toner image forming means on the basis of results of detection of said first and second detecting means; voltage control means for controlling the transfer voltage so that absolute value of the transfer voltage when the detection toner patch detected by said first detecting member is transferred from said image bearing member onto said recording material carrying member is smaller than an absolute value of the transfer voltage when the toner image detected by said second detecting member is transferred from said image bearing member onto intermediary transfer member.

DETAILED DESCRIPTION OF THE PREFERRED EMBODIMENTS

The image forming apparatus of the present invention is not limited to the restrictive structure of the embodiment described below.

As long as the toner image is sensed using the optical sensor accompanied by the exposure, another embodiment replaced by alternative structure thereof can also implement a part or all of the structure of the embodiment.

First Embodiment

Figure 1:
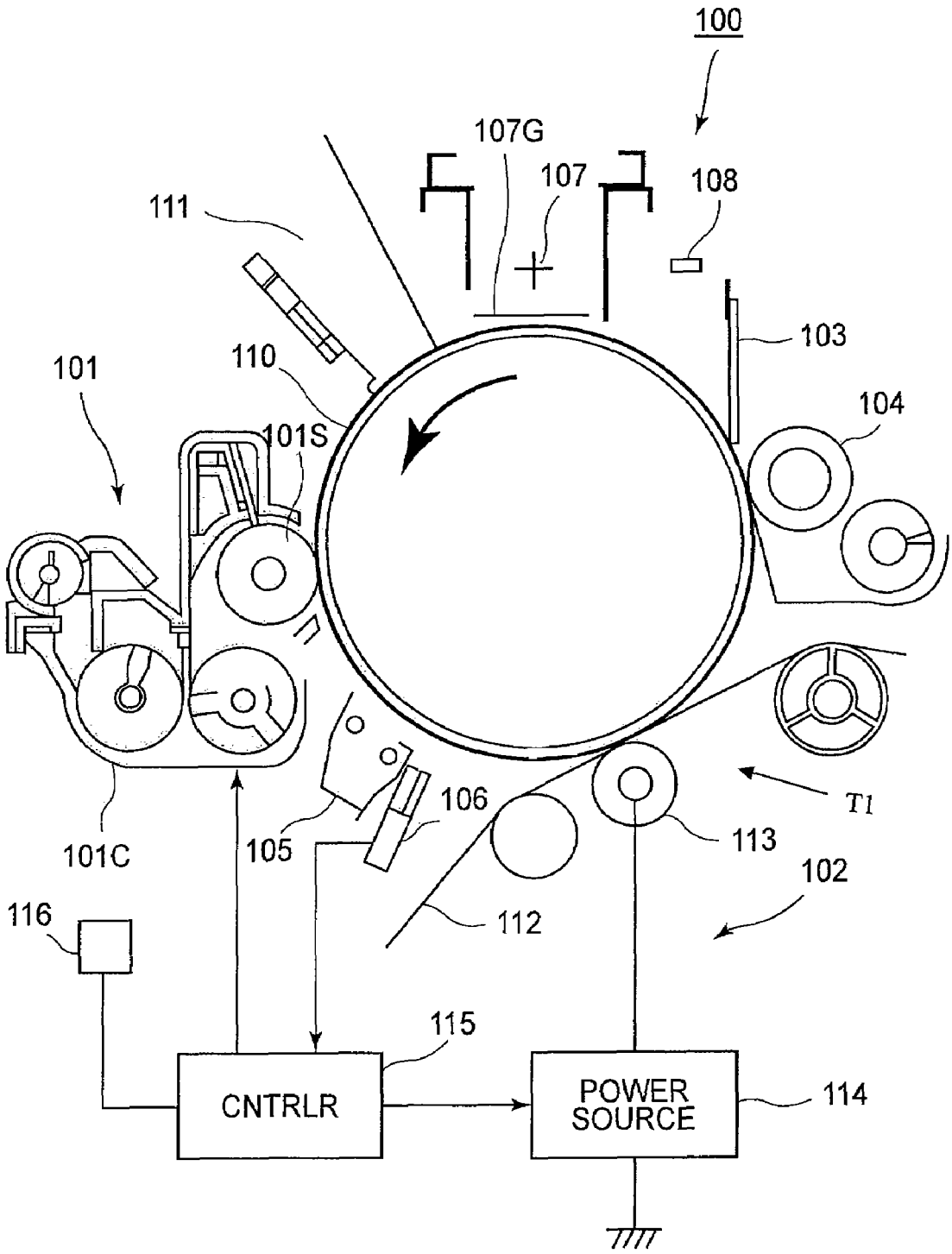
FIG. 1 is an illustration of a structure in the neighborhood of the photosensitive drum in an image forming apparatus of the a 1st embodiment.

FIG. 1 is the illustration of the structure of the photosensitive drum neighborhood in the image forming apparatus of the first embodiment.

And, carrier light of the reflected light from the density detecting toner image is carried out by the light receiving elements, such as the silicon Pin photo-diode (840-1150 nm of sensitive wavelength areas).

The controller 115 reads the density of the density detecting toner image at that time by the light quantity by which carrier light was carried out.

As shown in FIG. 1, the image forming apparatus 100 of the first embodiment effects the optical writing for the surface of the photosensitive drum 110 rotated in the direction of arrow in the FIG. by the exposure device 111, thus forming the electrostatic image. A developing device 101 develops a toner image by contacting the toner which is a developer to a photosensitive drum 110 arid making it attract to an electrostatic image. The toner image carried on the photosensitive drum 110 is primarily transferred onto an intermediary transfer belt 112 by a transferring device 102 in a primary transfer area T. The remaining toner after the primary transfer which remains on the surface of the photosensitive drum 110 without contributing to the primary transferring is removed by a cleaning device 104 after the primary transferring operation. The cleaning device 104 scrapes the remaining toner after the primary transfer off the drum by a cleaning blade 103 or the fur-brush contacted to the photosensitive drum 110.

After exposing and discharging the surface of the photosensitive drum 110 deprived of the remaining toner, after the primary transfer, uniformly by the pre-exposure device 108, the primary charger 107 charges it into the state of uniform charging.

As shown in FIG. 1, an optical sensor 106 for carrying out the density control of the developer is provided directly under a post-charger 105. A controller 115 controls the exposure device 111 and forms the density detecting toner image (the patch) on the non-image area which is the inter-sheet interval (between the images) space on the photosensitive drum 110. The density of the density detecting toner image is read using the optical sensor 106, and reading thereof is fed back for the density control of the developer at the time of the following image formation. In order to read the density of the density detecting toner image using the optical sensor 106, the density detecting toner image on the photosensitive drum 110 is irradiated with the light sources, such as the light emitting diode. The reflected light from the density detecting toner image is received by the light receiving elements, such as silicon Pin photo-diode (sensitive wavelength range of 840-1150 nm). The controller 115 reads the density of the density detecting toner image at that time by the light quantity received by the light receiving element. Each constituent-element used in the first embodiment will be described.

The image forming apparatus is provided with the photosensitive drum 110 (the electrophotographic photosensitive member of the rotatable drum type) as the image bearing member in the first embodiment. The photosensitive drum 110 includes the photosensitive layer formed with the organic light semiconductor (OPC) of the negative charging property. The photosensitive drum 110 has 84 mm in diameter, and is rotated in the direction of arrow at the process speed (the peripheral speed) of 285 mm/sec about an unshown central shaft. The length of the toner image formation area on the photosensitive drum 110 in the rotational-axis direction of the photosensitive drum 110 (longitudinal direction) is 290 mm. The density detecting toner image is the square of 2 cm×2 cm and is formed in the center portion of abbreviated with respect to the longitudinal direction of the toner image formation area. The density detecting toner image formed on the photosensitive drum 110 is exposed to the detecting light with the size of 7 mm of longitudinal directions in the process of passing by the optical sensor 106, and the reflected light therefrom is sensed.

There is provided a, primary charger 107 of a corona charger type as the non-contact-type charging member according to the first embodiment. The primary charger 107 charges the surface of the photosensitive drum 110 to −750 v uniformly by applying a bias voltage to the charging wire from the external voltage source and generating corona discharge. The charging wire of the first embodiment uses very stable tungsten among metal materials, and generates the corona discharge stabilized even under the severe heated conditions, and can continue stable operation over a long period of time. However, stainless steel, nickel, molybdenum and so on can be utilized for the charging wire.

The charging wire is retained by the constant tension by a holding member integral with a casing, and the discharging wire and the casing are electrically isolated from each other by the holding member which comprises an insulative material. It is desirable for the diameter of the charging wire to be 40 μm to 100 μm. If this diameter is too small, it disconnects by the collision of the ion by the discharging. On the contrary, if the diameter is too large, the voltage which should be applied to the discharging wire in order to obtain the stabilized corona discharge will become high. If applied voltage is high, the ozone tends to produce. In addition, the cost of the electric power source rises. In the first embodiment, the diameter of the charging wire is 50 μm.

The movement of the charge generated by the corona discharge from the charging wire is controlled by the voltage control of the grid electrode 107G connected with a constant voltage source, so that an amount of charge to move is adjusted and the charge potential of the photosensitive drum 110 is controlled. The grid electrode according to the first embodiment is a platen grid. It is an etching grid produced by masking and etching process to a stainless (SUS304) steel plate having a thickness of 0.1 mm and then electroplating it with chrome into 1 μm thickness. The voltage of the negative polarity is applied to the etching grid by the constant voltage source which can be controlled at any proper voltage to control the charge potential of the photosensitive drum 110.

In order to form an electrostatic image on the surface of the photosensitive drum 110 electrically charged by the primary charger 107, the image forming apparatus is provided with an exposure device 111 as information write-in means. The exposure device 111 is a laser beam scanning exposure apparatus which comprises a semiconductor laser source and a polygonal mirror optical system in the first embodiment. The surface potential of the photosensitive drum 110 charged to −750V is changed to −150V by exposure operation of the exposure device 111. If the density detecting toner image is exposed to the optical sensor 106, the potential of the portion having the density detecting toner image of the photosensitive drum 110 is changed to −50V.

A developing device 101 as the developing means supplies a developer (toner) to the electrostatic image on the photosensitive drum 110 to visualize the electrostatic image as a toner image. The developing device 101 is a reverse-developing device of a two-component magnetic-brush development type. The developing device 101 includes a developing container 101C and a developing sleeve 101S. The two-component developer is contained in the inside of the developing container 10C. The two-component developer is a mixture of the toner and the magnetic carrier. The magnetic carrier has a resistance of approx. $5\times10^8$ ohm-cm and an average particle size of 35 μm. The toner is triboelectrically charged to the negative polarity by the rubbing relative to the magnetic carrier.

The developing sleeve 101S is provided opposed closely to the photosensitive drum 110 in the state where the closest distance (S-D gap) between the photosensitive drum 110 and itself is retained at 350 μm. The opposing portion between the photosensitive drum 110 and the developing sleeve 101S is the developing zone. The surface of the developing sleeve 101S is rotated in the direction opposite to the moving direction of the surface of the photosensitive drum 110 in the developing zone. In other words, it is driven in the same rotational direction as the rotation of the photosensitive drum 110 indicated by an arrow. The developing sleeve 101S is provided with a magnet roller therein, and the two-component developer is conveyed to the developing zone by the magnetic force thereof with the rotation of the developing sleeve 101S. The magnetic brush layer is formed on the surface of the developing sleeve 101S, and it is regulated into the predetermined thin layer by the developer coating blade (not shown). A predetermined developing bias voltage is applied to the developing sleeve 101S from the developing bias applying voltage source.

In the first embodiment, the developing bias voltage applied to the developing sleeve 101S is the oscillation voltage which superimposed direct current voltage (Vdc) and alternating voltage (Vac). More specifically, the DC voltage is −350V, and the AC voltage is 1800V. The toner in the two-component developer is selectively deposited on the sleeve correspondingly to the electrostatic image on the photosensitive drum 110 by the electric field formed by the developing bias voltage. By this, the electrostatic image is developed into the toner image. At this time, the charge amount of the toner image on the photosensitive drum 110 is approx. −30 microC/g. The developer on the developing sleeve 101S which passed the developing zone is returned to the developer basin portion of the developing containers 101C with continuing the rotation of the developing sleeve 101S.

In the first embodiment, a transfer roller 113 is used as the transfer member. The transfer roller 113 is pressed with a predetermined urging force on the surface of the photosensitive drum 110 through an intermediary transfer belt 112, and the nip formed therebetween is the transfer portion. The intermediary transfer belt 112 is nipped and conveyed between the photosensitive drum 110 and the transfer roller 113.

The transfer bias voltage (+2.5 kV, for example) which has the positive polarity opposite to a regular charging polarity (the negative polarity) of the toner is applied to the transfer roller 113 from a transfer power source (the transfer bias application voltage source) 114. By this, the toner image on the photosensitive drum 110 is electrostatically transferred sequentially onto the surface of the intermediary transfer belt 112.

The controller 115 is the ordinary computer controller which is provided with processing functions and executes program control, for each part of the image forming apparatus 100 totally to form the image on the transfer material.

In the first embodiment, the cleaning blade 103 is provided as the cleaning means. The cleaning blade 103 is made of an elastic member of a urethane rubber, is press-contacted with a predetermined urging force on the surface of the photosensitive drum 110, and removes the remaining toner after the primary transfer.

The surface of the photosensitive drum 110 charged to −750 v by the primary charger 107 is exposed to the image light by the exposure device 111, by which the potential thereof is changed to −150V. The potential of the region of the density detecting toner image exposed to the optical sensor 106 is changed to −50V.

In this state, when the photosensitive member surface is charged by the primary charger 107 for the next image formation, it is difficult to charge the photosensitive member surface uniformly between the region which did not undertake the exposure by the exposure device 111, and the region which undertook the exposure by the exposure device 111 and the optical sensor 106, since the potential difference is large. For this reason, the non-uniformity appears in the formed image.

In order to solve the problem, the voltage applied to the transfer roller 113 during a period in which the inter-sheet space on the photosensitive drum 110 passes the primary transfer area T1 is controlled, by which the potential difference between the region which did not undertake the exposure by the exposure device 111, and the region which undertook the exposure by the exposure device 111 and the optical sensor 106, is decreased. For better understanding, the region which did not undertake the exposure by the exposure device 111 after the charging by the primary charger 107 is called an unexposed area, and the region which undertook the exposure by exposure device 111 and optical sensor 106 after the charging by the primary charger 107 is called a detection area.

In the control according to this embodiment, the voltage applied to the transfer roller 113 during a period in which the inter-sheet space portion of the photosensitive drum 110 passes the primary transfer area T is set, so that it is lower than the charge-starting voltage (the discharge threshold) relative to the potential of the unexposed area, and it is higher than the charge-starting voltage relative to the potential of the detection area.

By this control, the potential of the unexposed area is substantially after passing the primary transfer area T at −750 v. Since the detection area receives the discharging by the primary transfer area T, the potential thereof approaches the potential of the unexposed area, so that the potential difference between the unexposed area and the detection area becomes small. In this manner, the non-uniformity of the image can be reduced.

The detail of the control method will be described.

CONTROL EXAMPLE 1

Figure 2:
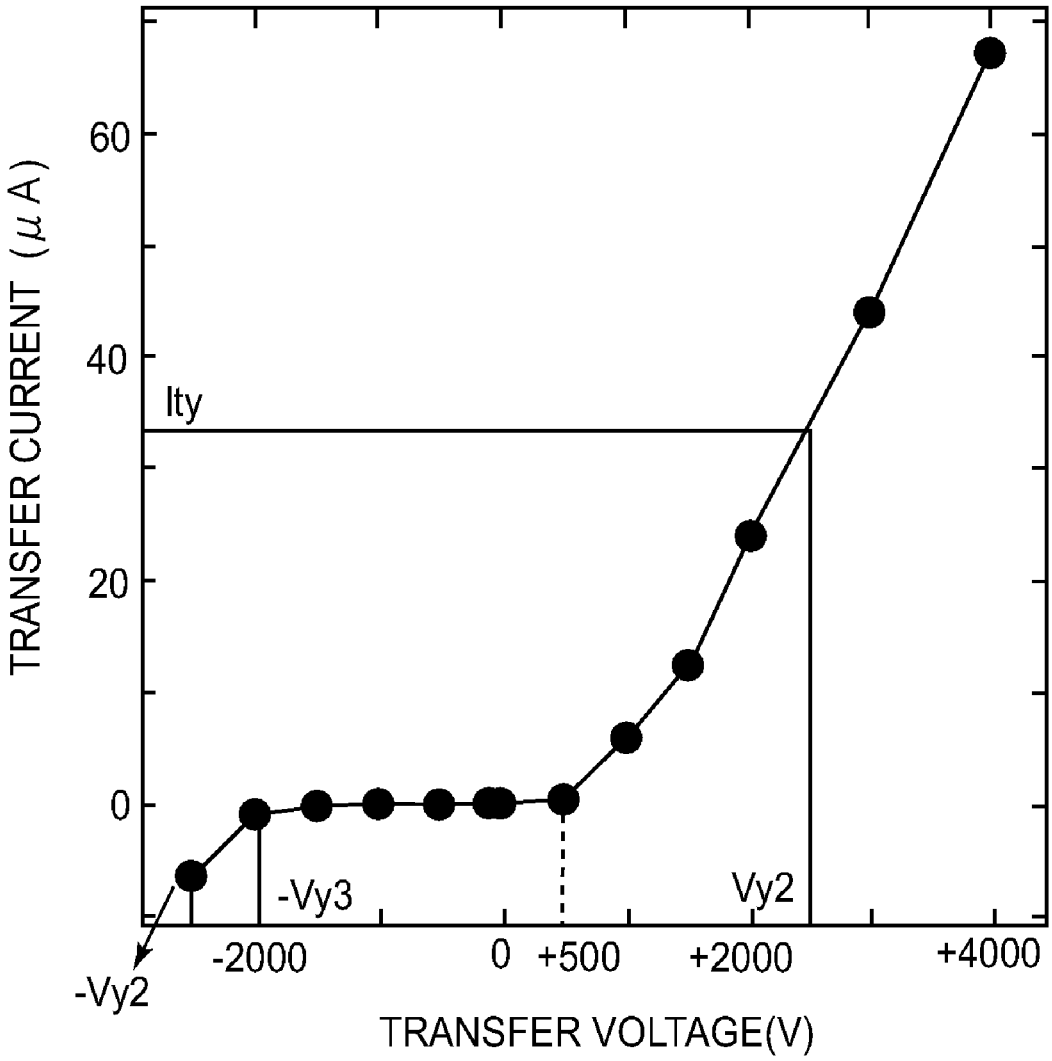
FIG. 2 is a diagram showing a relation between a transfer bias voltage and a transferring current.
Figure 3:
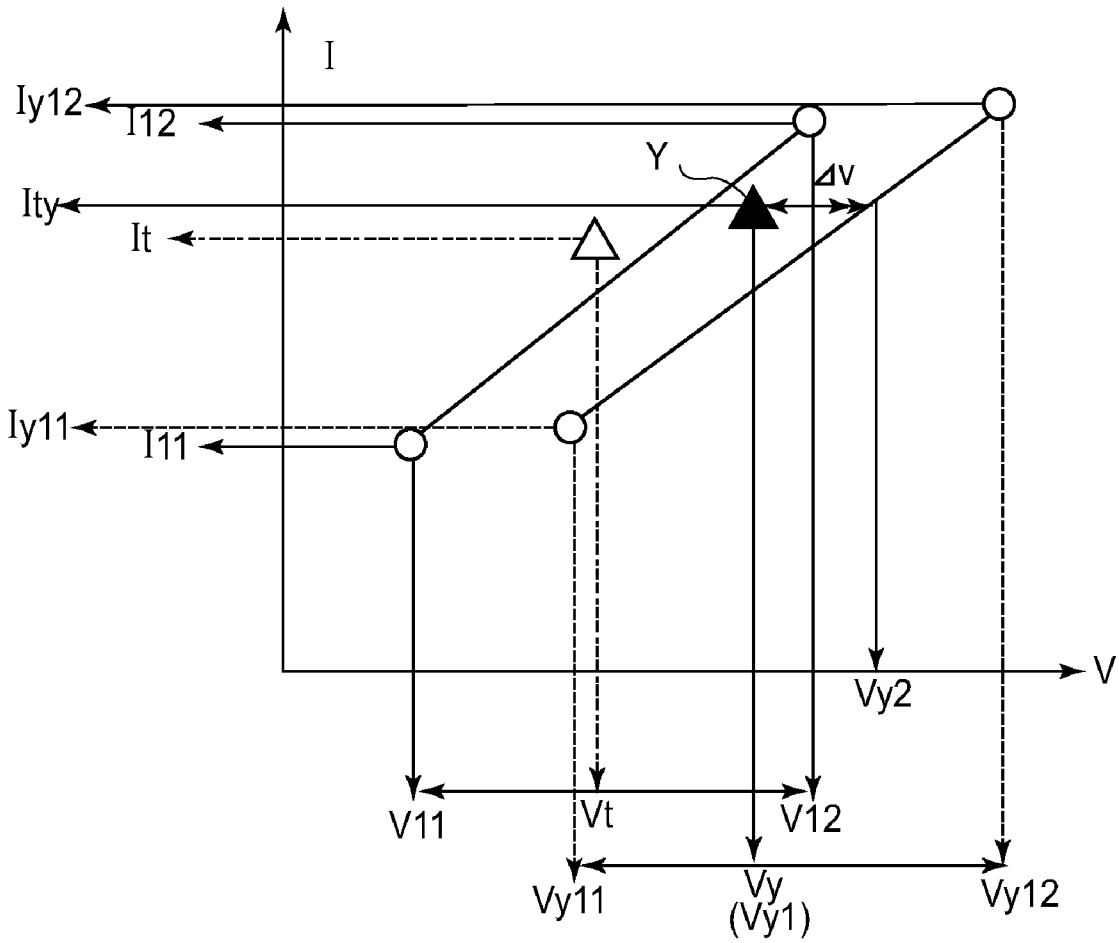
FIG. 3 is an illustration of a transfer bias voltage control operation.

In the structure of FIG. 1, a recoverying bias voltage, which has the opposite polarity relative to the polarity of the, transfer bias voltage which is applied at the time of the normal operation is applied to the exposed area of the density detecting toner image formed on the inter-sheet space of the surface of the photosensitive drum 110. The applying condition of the recoverying bias voltage is calculated on the basis of the control method of the transfer bias voltage applied at the time of the normal operation. The control method of the transfer bias voltage itself is proposed in Japanese Laid-open Patent Application Hei 5-297740 and Japanese Laid-open Patent Application No. 2001-215859 and so on, which is usable with this embodiment. According to the control example 1 of this embodiment, the recoverying bias voltage is set on the basis of this result. Referring to FIG. 2 and FIG. 3, the control example 1 will be described.

As shown in FIG. 2, if a transfer bias voltage of the positive polarity is applied to the transfer roller 113 at the time of the primary transfer, the current will flow into the photosensitive drum 110 through the intermediary transfer belt 112 from the transfer roller 113. The relation between applied transfer voltage (the voltage applied to the transfer roller 113) and the transferring current value (current value which flows through the transfer roller 113) shown in FIG. 2 is measured after the photosensitive drum 110 is charged to −750V. As will be understood from this Figure, the transferring current value increases to abrupt in the place where −2000V or +500V are applied as applied transfer voltage. From this, the charge-starting voltage is 1250V. Here, the charge-starting voltage is a difference required for the occurrence of the discharging between the charge potential of the photosensitive drum 110 and applied voltage to the transfer roller 113. The toner image is transferred onto the intermediary transfer belt 112 by the current generated by this, and the state of the charging of the surface of the photosensitive drum 110 changes toward transfer bias voltage from the state of the charging by the primary charger 107. The controller 115 sets transfer bias voltage which is to be outputted from the transfer power source 114 corresponding to the required transferring current value Ity processed in response to the image forming condition or ambient condition.

For example, in FIG. 3, the case of Y in FIG. 3 will be described. First, in the state where the developing device 101 is at rest (1) The first target current (It) that is a constant current is applied, and the voltages at that time (Vt) are detected.

(2) The voltage (V11) lower by 100V than the detection voltage (Vt) and the voltage (V12 and the constant voltage) higher by 100V than that are applied, and the detection currents (I11, I12) in respectively are detected.

(3) The required voltage (Vy) for the target current (Ity) of Y is determined from the relation between the voltages (V11, V12) and the detection currents (I11, I12).

(4) The developing device 101 operates.

(5) The target current (Ity) of Y is applied and the voltage at that time (Vy1) is sensed.

(6) The voltage (Vy11) lower by 100V than the detection voltage (Vy1) and the voltage (Vy12) higher by 100V than it are applied with the constant voltage, and the currents (Iy11, Iy12) are detected, respectively.

(7) The required voltage (Vy2) for the target current (Ity) of Y is determined from the relation between the voltages (Vy11, Vy12) and the detection currents (Iy11, Iy12).

(8) The difference required voltage (Vy2)−required voltage (Vy) is calculated, this difference is stored as the development off-set, and it is added to the result of control at the time of the pre-rotation.

The transfer bias voltage at the time of the normal operation is set on the basis of this result of processing. The recoverying bias voltage is set as follows based on this set condition.

In the control example 1, the voltage (−Vy2) is the recoverying bias voltage with respect to the result of the transfer bias voltage at the time of the normal operation (Vy2) in principle. However, in a high temperature and high humidity (30-degree C. and 80%) ambient condition, the set recoverying bias voltage (−Vy2) has the too high discharge current, and it results it in the excessive discharge area, and therefore, the voltage lower by 100V than this value is set to the recoverying bias voltage. The temperature and the humidity are sensed by an ambient condition detecting sensor (ambient condition detector) 116. The controller 115 controls the recoverying bias voltage on the basis of the result of detection of ambient condition detecting sensor 116.

As shown in FIG. 2, when the recoverying bias voltage (−Vy2 ) obtained by reverting the polarity of the transfer bias voltage at the time of the normal operation (Vy2) falls in the excessive discharge area, applied voltage value (−Vy3) immediately before the discharging is set as the recoverying bias voltage. For example, in the normal temperature (23-degree C. and 50%) ambient condition, the recoverying bias voltage is −3.5 kV relative to 3.5 kV of the set point of the transfer bias voltage at the time of the normal operation. This is fallen in the excessive discharge area, and therefore, 2.0-2.5 kV which is applied voltage value immediately before the discharging is selected as the required recoverying bias voltage.

Table 1 is a result at the time of the recoverying bias voltage being applied in the exposed area of the density detecting toner image on the basis of this set condition. Here, in the state in which the dark potential of the photosensitive drum 110 is set to −700V, the density detecting toner image is formed on the inter-sheet interval and area of the density detecting toner image is exposed to the LED light emitted by an optical sensor 106. The five half-tone images were formed continuously and the presence or absence of the image memory was determined in the next image after the LED irradiation. The results of Table 1 are the results when the transfer bias voltage and ambient condition are changed with the constant recoverying bias voltage.

TABLE 1

| | Discharged area | | Undischarged area | |
|---|---|---|---|---|
| Volt. | H.T/H.H | N | H.T/H.H | N |
| −100 V | No | Yes | No | |
| −1500 V | No | No | | |
| −2000 V | No | No | | |
| −2500 V | No | No | | |
| −Vy3 | No | No | | No |

As will be understood from Table 1, the image memory is not produced with the recoverying bias voltage set independently of the recoverying bias voltage in the high temperature and high humidity ambient condition. However, in the normal temperature (23-degree C. and 50%) ambient condition, there was a case where the image memory was produced with a part of the set point of the recoverying bias voltage voltages. However, this condition resulted in the image memory is not fulfilled by the setting of the transfer bias voltage at the time of the normal operation. If the transfer bias voltage is applied under these conditions at the time of the normal operation, the improper transfer will occur. Therefore, practically, since this condition is the control range which can be disregarded, it is confirmed that the control method in control example 1 is effective.

In control example 1, −1500V is applied to the transfer roller 113 as the recoverying bias voltage. At this time, the potential difference between the recoverying bias voltage, and potential of the region (the region which has −750 v) of the photosensitive drum 110 charged by the primary charger 107 is 750 v, and it is less than the charge-starting voltage (1250 v). On the other hand, the potential difference between the recoverying bias voltage and the potential of the region (−50 v) of the density detecting toner image exposed by the optical sensor 106 is 1450 v, and it is greater than the charge-starting voltage.

CONTROL EXAMPLE 2

In the structure shown in FIG. 1, the image memory may not be produced on the image depending on the size of the used transfer material on the basis of a diameter of the photosensitive drum 110. For example, in the case of the paper of the A4 size, the toner images are formed at the substantially constant phase position of the photosensitive drum 110. Therefore, the image memory generated by the exposure when the LED exposure by the optical sensor 106 is carried out in an inter-sheet interval appears in a following inter-sheet interval. For this reason, the image memory is not produced on the image.

However, the image memory is produced on the image on the basis of the diameter of the photosensitive drum 110 with respect to other paper sizes, and therefore, the control for changing the recoverying bias voltage value in response to the size is desired.

In addition, the image memory itself is not produced in the small sizes, such as the A4 size, the portion supplied in the recoverying bias voltage is the leading end position of the following image, and therefore, an impact image may appear on the image. For this reason, the control responsive to the size or the paper kind is desired.

Table 2 shows the set conditions in a control example 2. The presence or absence of the production of the image memory in each condition is the same as case of control example 1. In addition, the usable range which also takes a problem other than the image memory into the consideration is Y relative to recoverying bias voltage values, and it is N about the region which involves the problem. Since the production of the image memory is not observed in the usable range, control example 2 is a preferable control method. The setting here does not necessarily include control example 1.

TABLE 2

| | Kinds | | | |
|---|---|---|---|---|
| Volt | A4 | A3 | LTR | LDR |
| −100 V | Y | N | Y | N |
| −1000 V | Y | N | Y | N |
| −1500 V | N | N | N | N |
| −2000 V | N | Y | N | Y |
| −2500 V | N | Y | N | Y |

CONTROL EXAMPLE 3

In the structure shown in FIG. 1, the recoverying bias voltage at the time of the density detecting toner image formation is set on the basis of the dark potential setting for each color at the time of the normal operation. Since the light potential of the LED exposed area by the optical sensor 106 is not constant relative to each dark potential, the recoverying bias voltage which can be shifted to the light potential area which does not result in the production of the image memory in the total color is preferable.

For this reason, the recoverying bias voltage which can cover the potential difference in the unexposed area and the exposed area is desired.

The necessary and sufficient condition for the recoverying bias voltage for accomplishing this is the recoverying bias voltage in exposed area falling in the discharge region, and the dark potential portion or the recoverying bias voltage in unexposed area falling in the undercharged region. Table 3 shows the results of the implementation of control example 3. Table 3 deals with amount of required recoverying bias voltage applications relative to the dark potential setting for the magenta.

TABLE 3

| | Dark potential | | | |
|---|---|---|---|---|
| Volt. | −400 V | −500 V | −600 V | −700 V |
| −100 V | Y | Y | Y | Y |
| −1000 V | Y | Y | Y | Y |
| −1500 V | Y | Y | Y | N |
| −2000 V | N | N | N | N |
| −2500 V | N | N | N | N |

In control example 3, the dark potential is changed in the normal temperature (23-degree C. and 50%) ambient condition on the basis of the structure of FIG. 1. The density detecting toner image is formed on the inter-sheet interval with the constant development contrast in the half-tone images, and the image is exposed to the light emitted from LED of the optical sensor 106. Under these conditions, the five continuous images were formed, and the presence or absence of the production of the image memory was observed. The result thereof shows that the image memory is not produced by increasing the reverse bias voltage value irrespective of the dark potential, and, in addition, it shows that the latitude relative to the production of the image memory expands with the reduction of the dark potential. What is necessary is just to employ the voltage range shown by N in Table 3. From this, it is confirmed that it is effective for the prevention of the image memory production to decrease the dark potential and to increase the recoverying bias voltage. These settings do not necessarily include the control example 1 or the control example 2.

CONTROL EXAMPLE 4

In the structure shown in FIG. 1, the production of the image memory has the tendency of being reduced by the LED exposure amount provided by the optical sensor 106 at the time of the density detecting toner image formation. This means that the image memory is dependent on the difference between the dark potential in the non-exposure area, and the light potential at the time of the exposure. For this reason, the production of the image memory can be suppressed by suppressing the LED exposure amount. However, since the reduction of the LED exposure itself by the optical sensor 106 affects adversely on the image stabilizing control, the predetermined exposure amount should be maintained.

The set conditions shown in Table 4 are the settings of the recoverying bias voltage corresponding to the LED exposure amount by the optical sensor 106. The evaluation about presence or absence of the production of the image memory in each condition is the same as the evaluation of control example 1. As will be understood from Table 4, the image memory is reduced regardless of the set point of the recoverying bias voltage with the reduction of the LED exposure amount, and the latitude with respect to the image memory production narrows with the increase of the exposure amount. From the result of Table 4, by increasing the recoverying bias voltage in response to the LED exposure amount by the optical sensor 106 for the density detecting toner image sensing used, the image memory can be suppressed without adverse affect to the image stabilizing control. The LED exposure amount by the used optical sensor 106 is measured as the maximum instantaneous exposure amount at wavelength 880 nm by the optical power meter available from ADVANTEST on the surface of the photosensitive drum 110. Control example 4 does not necessarily include above described control examples.

TABLE 4

| | Exp. | | | |
|---|---|---|---|---|
| Volt. | 20 μW | 50 μW | 100 μW | 200 μW |
| −100 V | N | Y | Y | Y |
| −1000 V | N | Y | Y | Y |
| −1500 V | N | N | Y | Y |
| −2000 V | N | N | N | N |
| −2500 V | N | N | N | N |

CONTROL EXAMPLE 5

Figure 4:
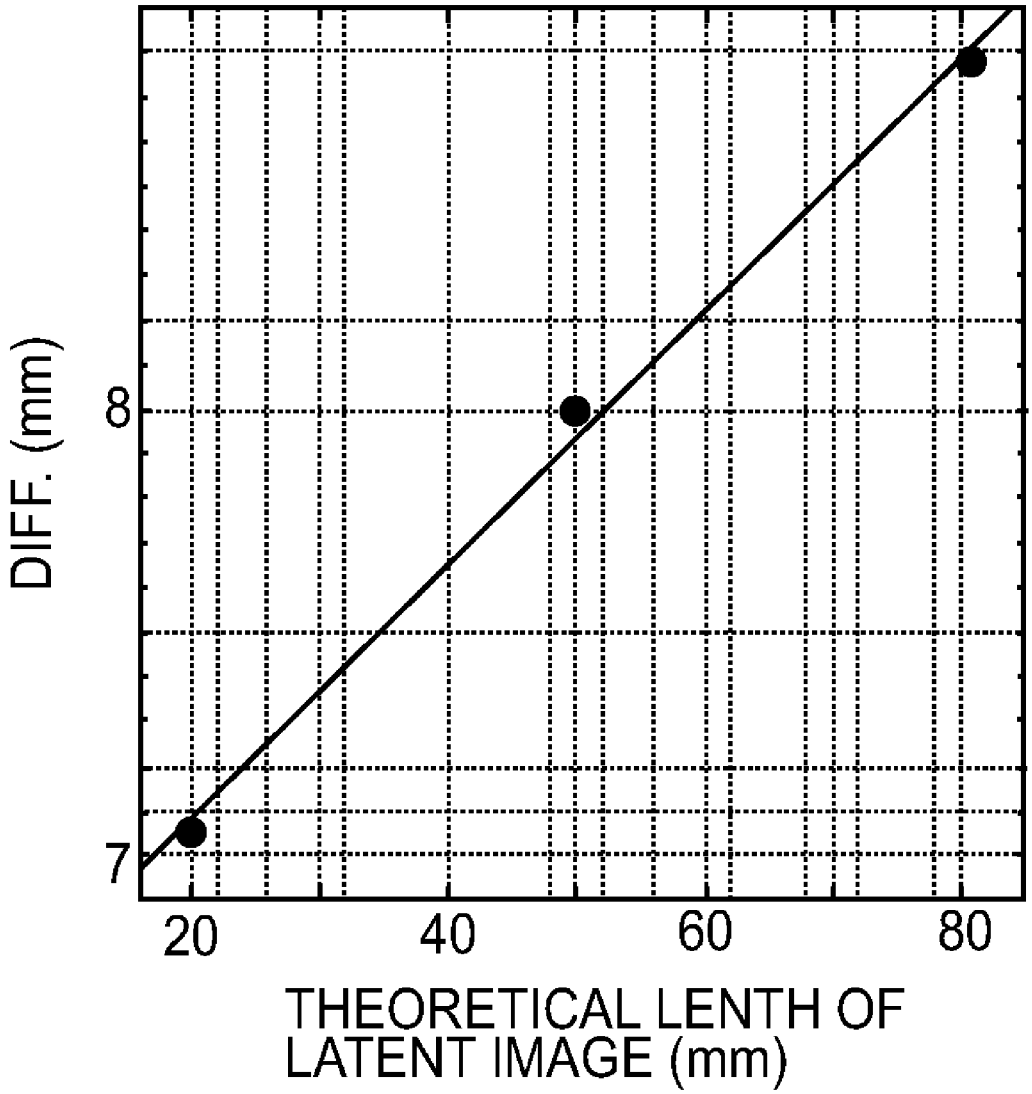
FIG. 4 is a diagram which illustrates a difference between a latent image width and an image memory width.

FIG. 4 is the diagram showing the difference between the latent image width and the width of the image memory. In the structure shown in FIG. 1, in order to compensate the change amount which includes the time of the LED exposure of the photosensitive drum 110, and the diffraction scattering by a dispersal system, in control example 5, the time of application of the recoverying bias voltage is controlled. Here, by setting the time of the LED exposure of the optical sensor 106 for the density detecting toner image sensing in relation to circumferential length of 83 mm/sec of the photosensitive drum 110, the latent image length formed on the photosensitive drum 110 is determined. For example, when the time of the exposure with above described peripheral speed is 70 msec, theoretical latent image width is approx. 20 mm. However, a dispersal system, especially the photosensitive drum 110 in the copying machine, and the toner dispersal system in the neighborhood of the developing device 101 tend to involve the diffraction scattering light in terms of the wavelength LED of the optical sensor 106 used. Therefore, the image memory longer than theoretical latent image width appears on the image.

In view of this, in control example 5, the difference between the latent image width on the photosensitive drum 110 and the width of the image memory on the image is taken into the consideration. FIG. 4 shows this difference. On the basis of this difference, the time of application of the recoverying bias voltage is determined as shown in Table 5. About the presence or absence of the production of the image memory in control example 5, the dark potential was set to −700V, and, when the image formation of the half-tone image was carried out without application of the recoverying bias voltage, the width of the image memory was measured. This is the condition of the production of the image memory, without using control examples 1-4. Control example 5 can be used with all of above described control examples 1-4., the control which can assure the exposed area by this control is provided.

TABLE 5

| Theoretical width | Bias application duration |
|---|---|
| 20 mm | 115 msec |
| 50 mm | 219 msec |
| 80 mm | 325 msec |

Second Embodiment

Figure 5:
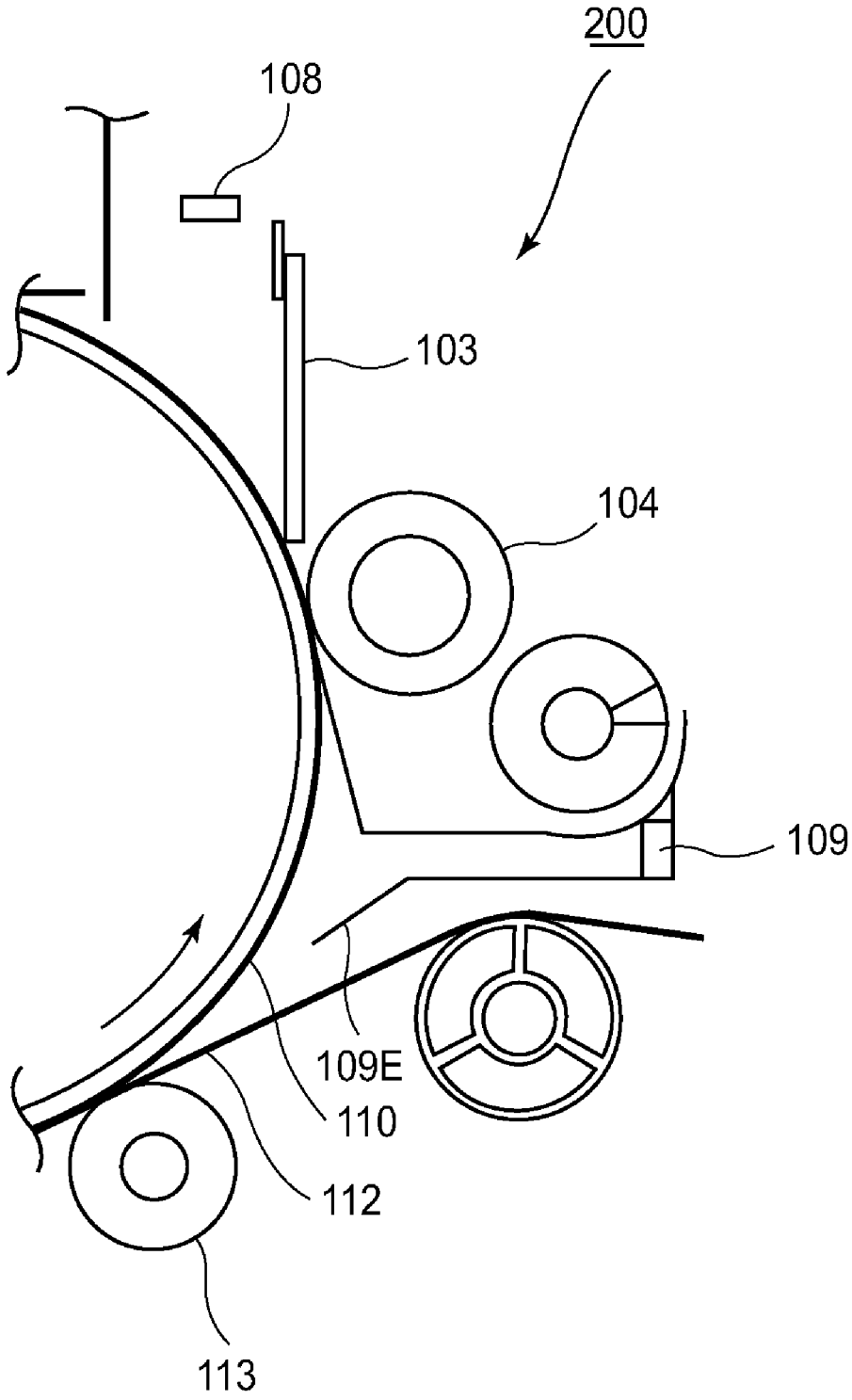
FIG. 5 is an illustration of a structure of a neighborhood of a photosensitive drum in an image forming apparatus of a second embodiment.
Figure 6:
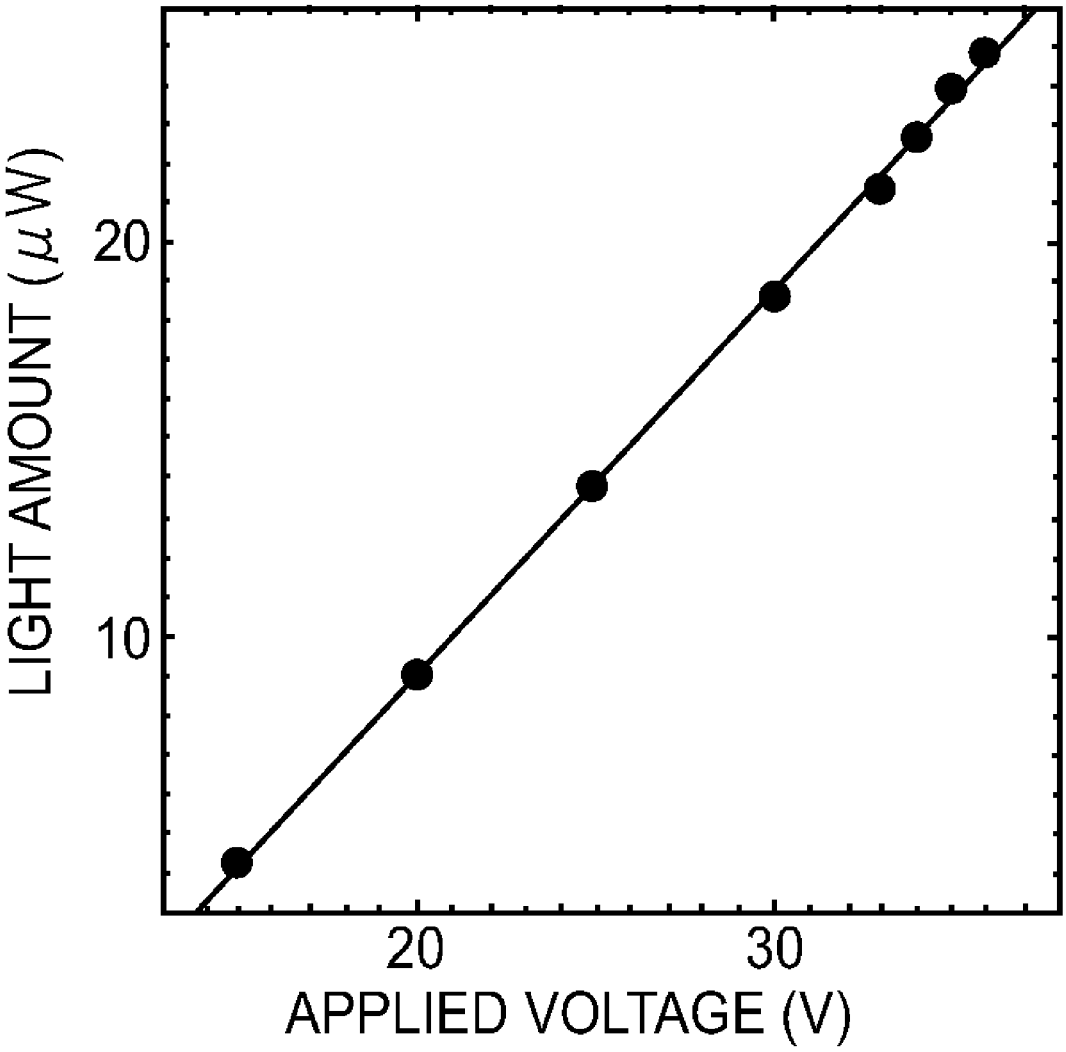
FIG. 6 is a diagram of an exposure amount in a pre-exposure.
Figure 7:
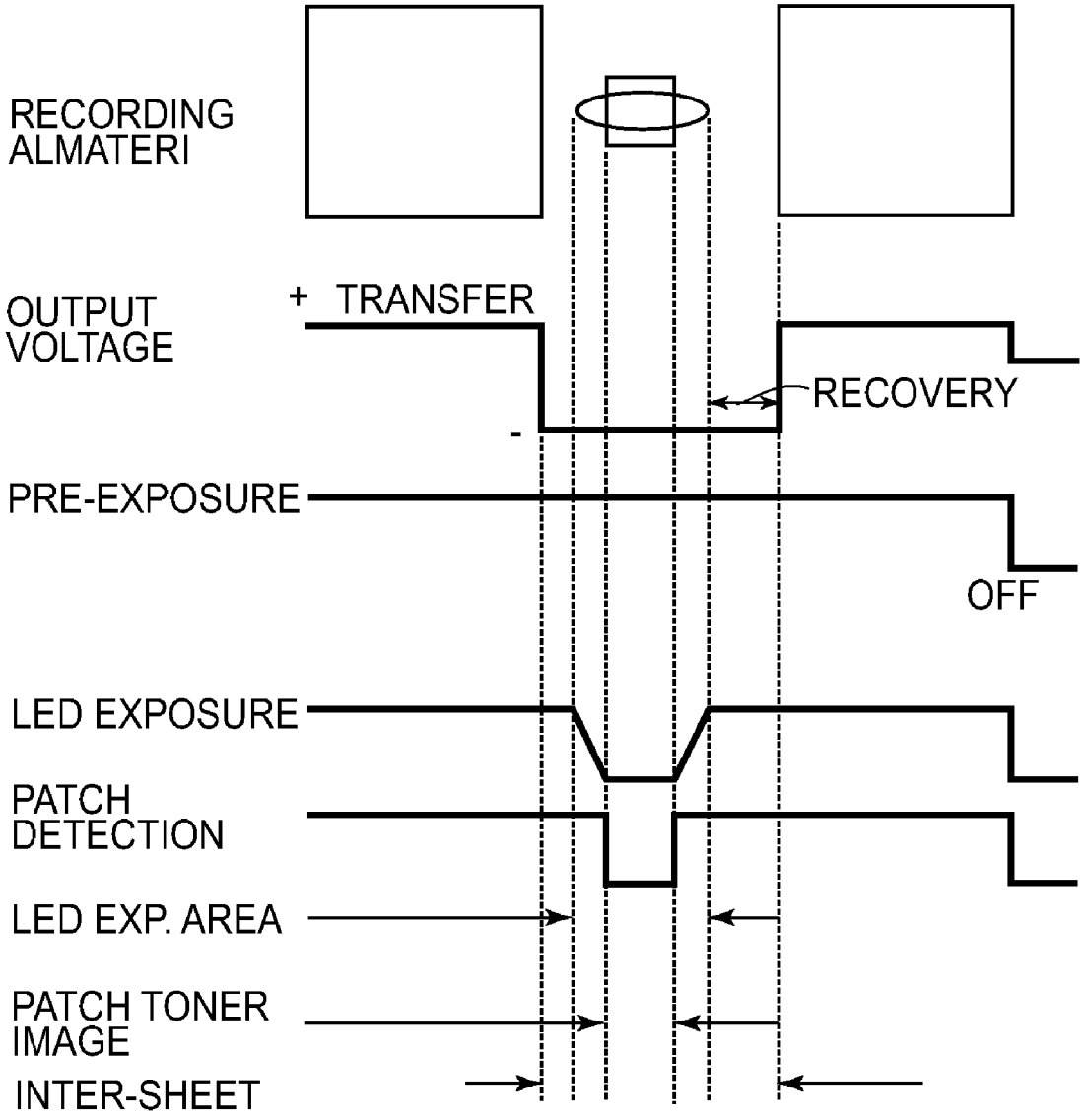
FIG. 7 is an illustration of a control in an inter-sheet interval in the pre-exposure.

FIG. 5 is an illustration of a structure in the neighborhood of a photosensitive drum in an image forming apparatus of the second embodiment, FIG. 6 is a diagram of the exposure amount in the pre-exposure, and FIG. 7 is an illustration of the control in the inter-sheet interval in the pre-exposure. The image forming apparatus 200 of the second embodiment is the same as the image forming apparatus 100 of the first embodiment except for the provision of the pre-exposure device 109 disposed upstream of the cleaning device 104. Therefore, in FIG. 5, the common reference numeral is given to the structure that it is common with FIG. 1, and the detailed description therefor is omitted for the sake of simplicity.

In order that the uniformitarian of the potential may be improved more and the production of the image memory may be prevented than the structure shown in FIG. 1, a pre-exposure device 109 is added in the second embodiment. As shown in FIG. 5, the pre-exposure device 109 is disposed upstream of the cleaning device 104 downstream of the primary transfer roller 113 with respect to the rotational direction of the photosensitive drum 110. Since the pre-exposure device 109 is provided downstream of the primary transfer portion, the possibility of the scattering contamination by the toner arises with the primary transfer of the toner image from the photosensitive drum 110 to the intermediary transfer belt 112. In order to avoid this, the prevention plate 109E of a scattering for the scattering contamination prevention is provided.

The pre-exposure device 109 used in the second embodiment is the LED array element available from Stanley similarly to the pre-exposure device 108 for irradiating the surface of the photosensitive drum 110 after the cleaning. Therefore, the circumferential surface of the photosensitive drum 110 is exposed in the shape of linear in alignment with shaft orientations. However, this embodiment is not limited to such an example.

The light quantity supplied by the pre-exposure device 109 on the surface of the photosensitive drum 110 is measured as at maximum instantaneous exposure amount in the wavelength 660 nm by the optical power meter available from ADVANTEST. FIG. 6 shows the result of the measurement. On the basis of this result, the pre-exposure device 109 is set to 5-25 microwatts, and it is incorporated in the control example 1, 3, 4 of the first embodiment. The experiments for evaluating the suppression effect of the image memory were effected. In the experiments, the image forming apparatus is operated similarly to above described control examples, and the pre-exposure device 109 is controlled with the control method shown in FIG. 7.

As shown in FIG. 7, when the density detecting toner image passes the primary transfer roller 113, it is supplied with the recoverying bias voltage of the negative polarity, so that the density detecting toner image of the negative polarity remains in the photosensitive drum, without transferring, and reaches the pre-exposure device 109. Since the exposure LED of the optical sensor 106 is blocked by the density detecting toner image when there is no exposure by the pre-exposure device 109, the potential difference arises between the inner side of the density detecting toner image, and the outside of the density detecting toner image, and it appears as the image memory. The exposure by the pre-exposure device 109 is carried out in order to avoid this. Table 6 shows the result thereof.

TABLE 6

| | Pre-exp | | | |
|---|---|---|---|---|
| Volt | 5 μW | 10 μW | 20 μW | 25 μW |
| −100 V | Y | N | N | N |

The result of Table 6 is the result of the production of the image memory obtained when 5-25 microwatts of pre-exposure was affected in the high temperature and high humidity ambience and the high reverse bias voltage value (recoverying bias voltage voltage-100V) was applied. This result shows that the production of the image memory which appeared in above described control example 1 is avoidable by increasing the exposure amount.

Table 7 is the result at the time of changing the dark potential condition in the normal temperature condition, and the production of the image memory is evaluated with respect to the pre-exposure and the high reverse bias voltage value relative to this set point. There is much region where the image memory does not produce in the case of the low dark potential. When these results are considered, the low dark potential, and the large exposure amount and the large reverse bias voltage value are desirable from the standpoint of the suppression effect of the image memory.

TABLE 7

| | Pre-exp | | | |
|---|---|---|---|---|
| Volt | 5 μW | 10 μW | 20 μW | 25 μW |
| | Dark potential −400 V | | | |
| −100 V | Y | Y | N | N |
| −1000 V | Y | Y | N | N |
| −1500 V | Y | Y | N | N |
| | Dark potential −500 V | | | |
| −100 V | Y | Y | N | N |
| −1000 V | Y | Y | N | N |
| −1500 V | Y | Y | N | N |
| | Dark potential −600 V | | | |
| −100 V | Y | Y | N | N |
| −1000 V | Y | N | N | N |
| −1500 V | Y | N | N | N |
| | Dark potential −700 V | | | |
| −100 V | Y | Y | N | N |
| −1000 V | Y | N | N | N |
| −1500 V | N | N | N | N |

Table 8 is the result at the time of changing the pre-exposure amount in the normal temperature condition, and is the result of investigating the production of the image memory with respect to high reverse bias voltage value and the LED exposure amount of the optical sensor 106. Also under the conditions which resulted in the production of the image memory in control examples 1-5 of the first embodiment, the production of the image memory is avoidable by setting the exposure amount of the pre-exposure device 109 in response to the exposure amount LED of the optical sensor 106.

TABLE 8

| | LED Pre-exp | | |
|---|---|---|---|
| Volt | 50 μW | 100 μW | 200 μW |
| | Pre-exp 5 μW | | |
| −100 V | Y | Y | Y |
| −1000 V | N | Y | Y |
| −1500 V | N | N | N |
| | Pre-exp 10 μW | | |
| −100 V | Y | Y | Y |
| −1000 V | N | N | N |
| −1500 V | N | N | N |
| | Pre-exp 20 μW | | |
| −100 V | Y | N | N |
| −1000 V | N | N | N |
| −1500 V | N | N | N |
| | Pre-exp 25 μW | | |
| −100 V | Y | N | N |
| −1000 V | N | N | N |
| −1500 V | N | N | N |

According to the image forming apparatus 200 of the second embodiment, the pre-exposure device 109 is used together and application of the recoverying bias voltage is carried out. By doing so, the image memory is more effectively suppressed than in the case of the usage of only application of the recoverying bias voltage, and a further improvement of the image quality is accomplished.

Third Embodiment

Figure 8:
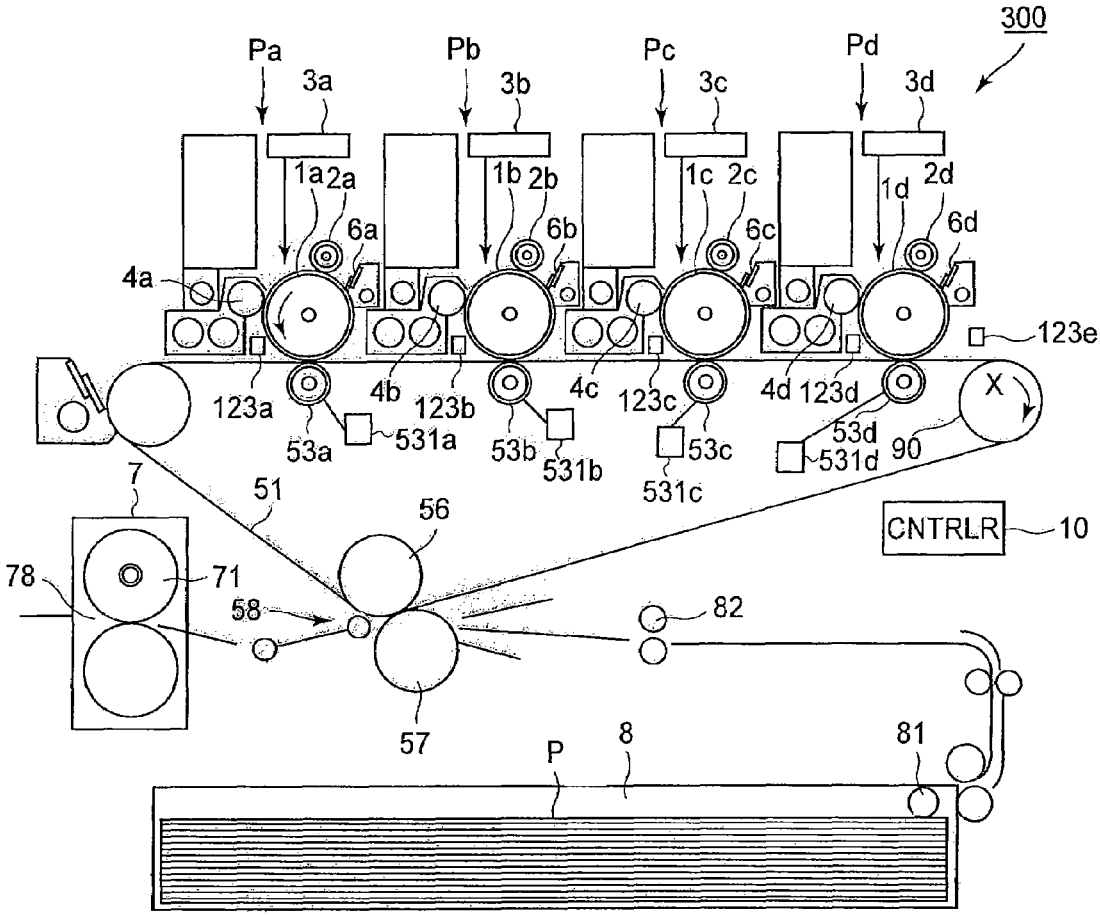
FIG. 8 is a sectional view which illustrates a general arrangement of an image forming apparatus of a third embodiment.
Figure 9:
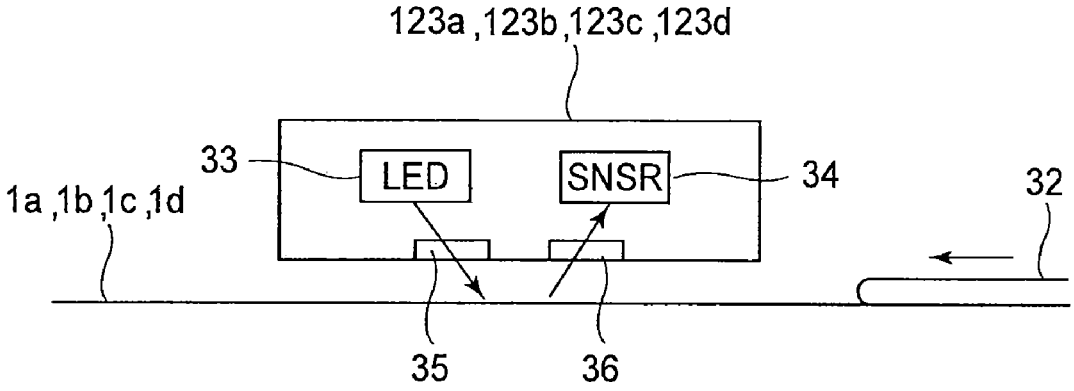
FIG. 9 is an illustration of first toner image detection by an optical sensor.
Figure 10:
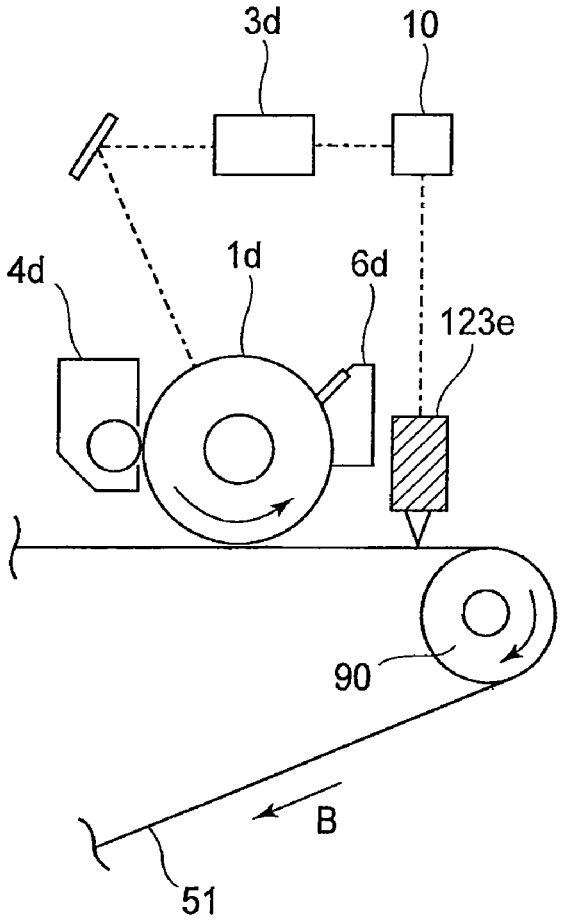
FIG. 10 is an illustration of detection of a pattern image for a registration correction by a pattern image detection portion.
Figure 11:
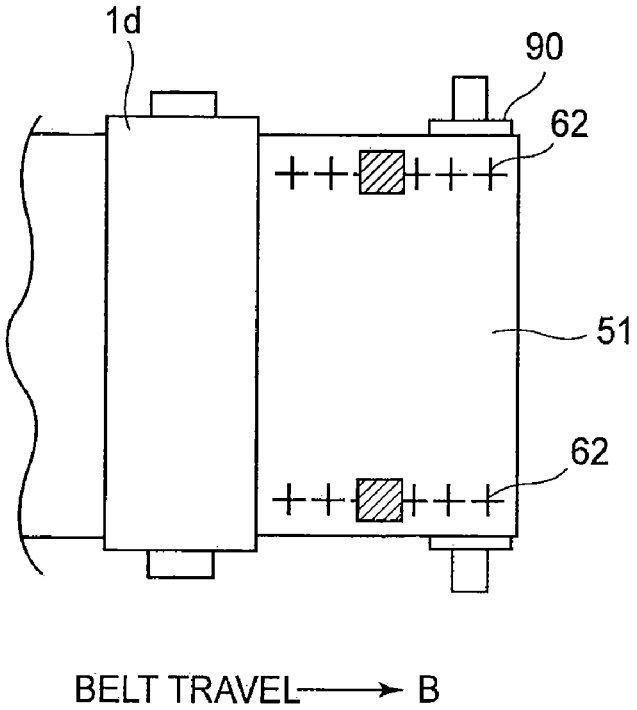
FIG. 11 is an illustration of an arrangement of the pattern image for the registration corrections on an intermediary transfer belt.
Figure 12:
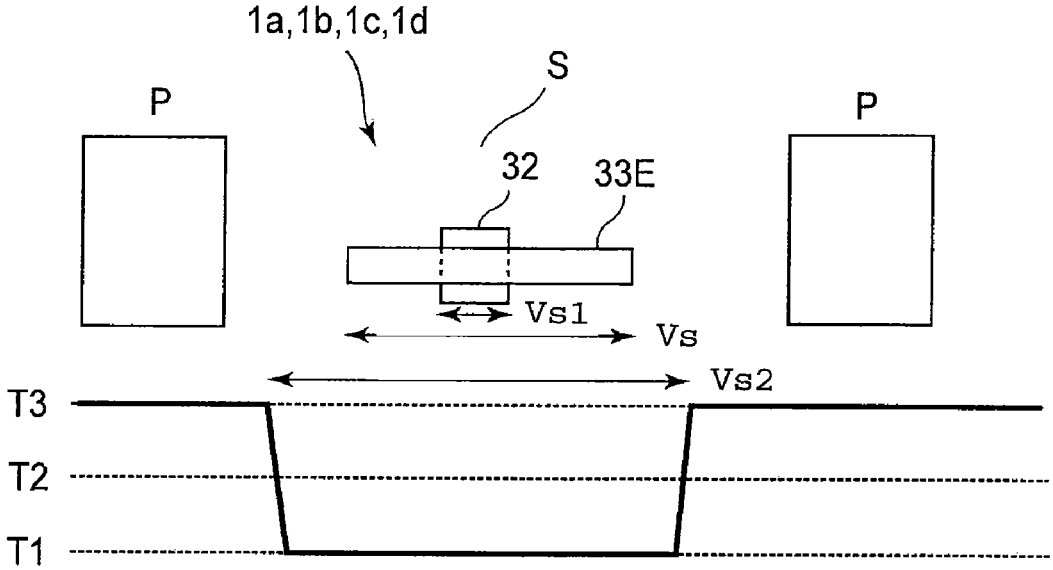
FIG. 12 is an illustration of the exposure by an optical sensor.
Figure 13:
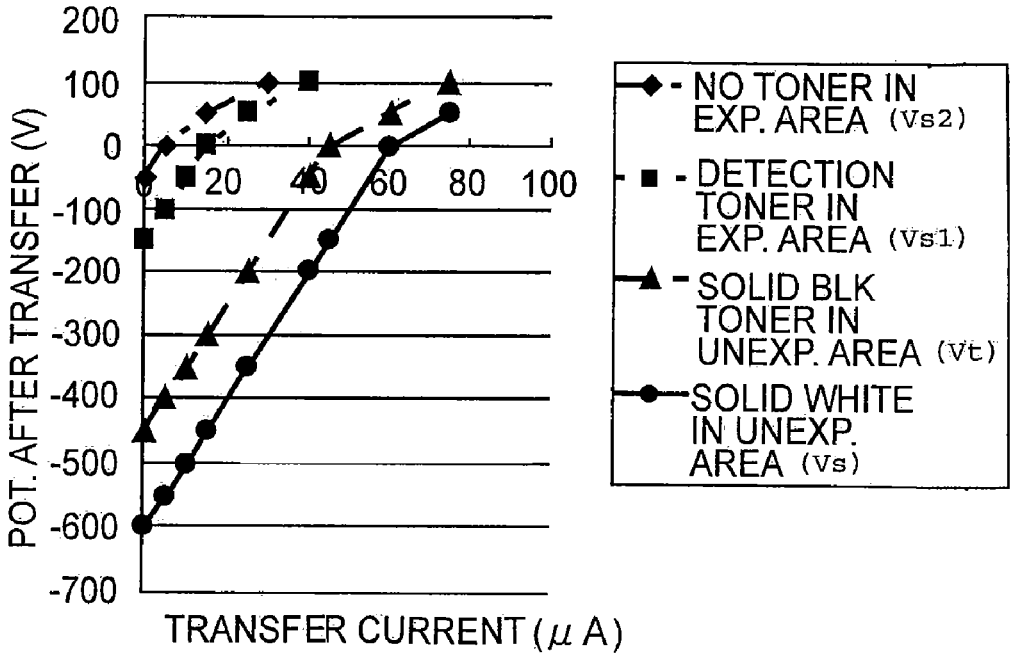
FIG. 13 is a diagram showing a relation between a transferring current and a surface potential of the photosensitive drum.
Figure 14:
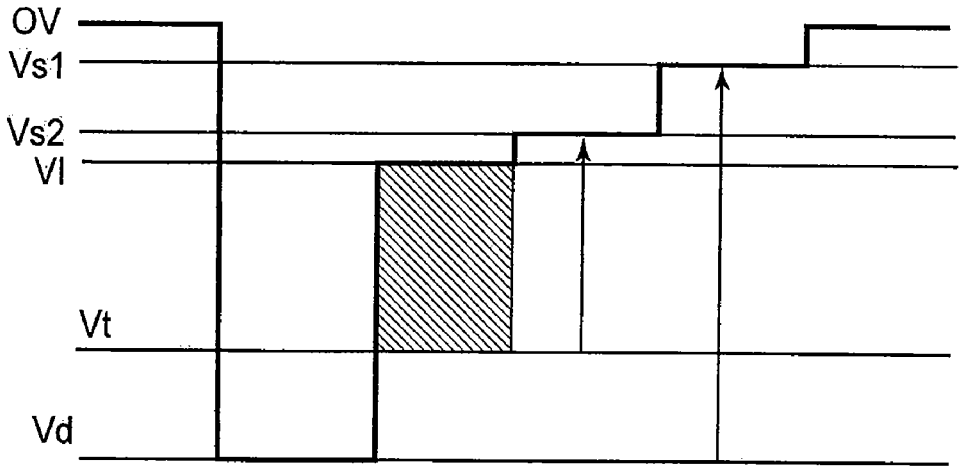
FIG. 14 is an illustration of the influence of the exposure by the optical sensor relative to the surface potential of the photosensitive drum.
Figure 15:
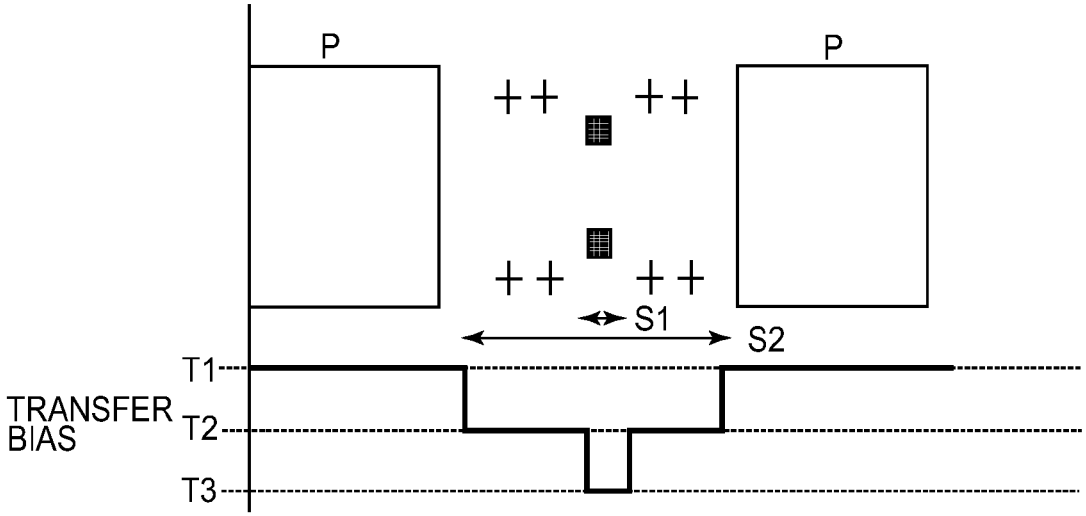
FIG. 15 is an illustration of a bias armature-voltage control in the inter-sheet interval period.
Figure 16:
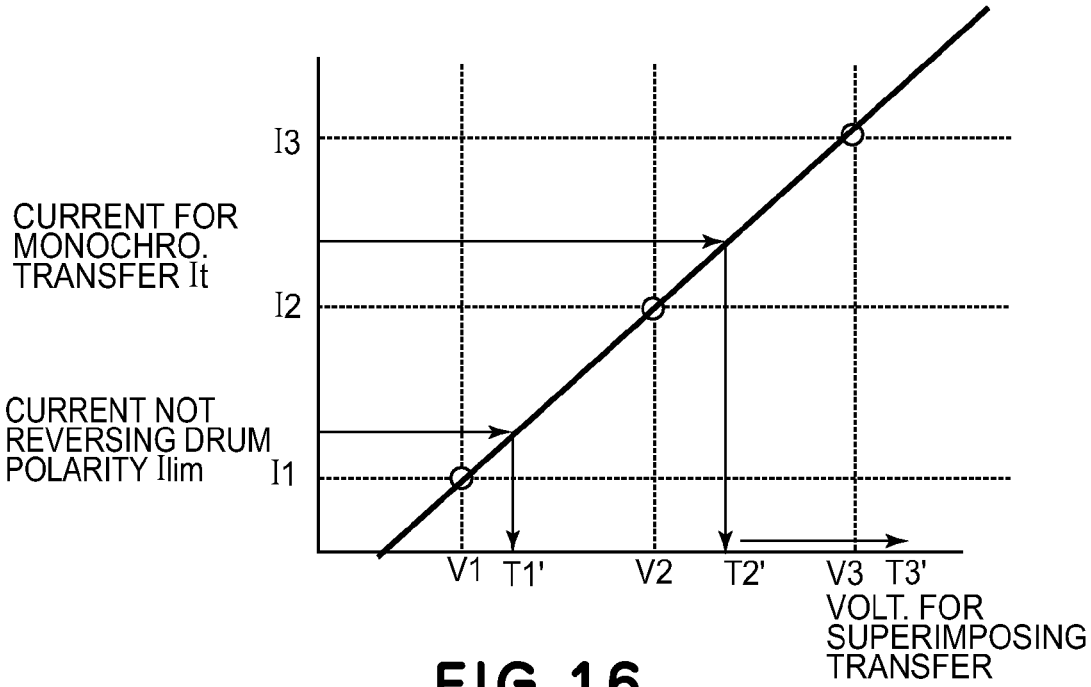
FIG. 16 is an illustration of a bias voltage setting.

FIG. 8 is a sectional view which illustrates a schematic structure of an image forming apparatus of the third embodiment, and FIG. 9 is an illustration of a detection of the density detecting toner image by an optical sensor. FIG. 10 is an illustration of a detection of the pattern image for registration correction by the pattern image detector, and FIG. 11 is an illustration of an arrangement of the pattern image for registration correction in an intermediary transfer belt. FIG. 12 is an illustration of the exposure by the optical sensor, and FIG. 13 is the diagram showing the relation between a transferring current and a surface potential of a photosensitive drum. FIG. 14 is an illustration of the influence of the exposure by optical sensor to the surface potential of the photosensitive drum, FIG. 15 is an illustration of the bias voltage control in the inter-sheet interval, and FIG. 16 is an illustration of the bias voltage setting.

As shown in FIG. 8, a intermediary transfer belt 51 which is an endless belt member traveling in the direction of an arrow X is disposed in the inside of a main assembly of a image forming apparatus 300. The intermediary transfer belt 51 is stretched by a plurality of rollers, and is constituted with the electroconductive or dielectric resin materials, such as the polycarbonate, polyethylene terephthalate resin material film, or polyvinylidene fluoride resin material film. In the third embodiment, the intermediary transfer belt 51 is a product made from electroconductive polyimide. A transfer material P taken out from a feeding cassette 8 by a feeding roller 81 is supplied to a secondary transfer portion 58 through a registration roller 82. Above the intermediary transfer belt 51, the four image forming stations Pa, Pb, Pc, and Pd of the substantially similar structure are provided in series.

The a controller 10 is a computer controller (the program control) ordinarily provided with a processing function, the various parts of the image forming apparatus 300 are controlled synthetically to form the full-color image on the transfer material P.

The structure of the example of the image forming station Pa will be described. The image forming station Pa comprises a photosensitive drum 1*a* which is the rotatable electrophotographic photosensitive member in the form of a drum a. Around the photosensitive drum 1*a*, the process means, such as a primary charger 2*a*, a developing device 4*a*, and a cleaning device 6*a*, are provided. Other image forming stations Pb, Pc, Pd have the structure similar to the image forming station Pa. However, these image forming stations Pa, Pb, Pc, and Pd differ in that they form the toner images of the magenta, cyan, yellow, and black colors. In the developing devices 4*a*, 4*b*, 4*c*, 4*d* provided on the image forming stations Pa, Pb, Pc, Pd, the magenta toner, the cyan toner, the yellow toner, and the black toner are contained, respectively.

The image signal of the magenta component color of the original is supplied onto the photosensitive drum 1*a* through the exposure device 3*a* provided with the polygonal mirror etc., so that an electrostatic image is formed. The toner is supplied to this electrostatic image from the developing device 4*a*, so that the electrostatic image is developed into a toner image. This toner image arrives at the primary transfer portion where the photosensitive drum 1*a* and the intermediary transfer belt 51 contact with each other, with the rotation of the photosensitive drum 1*a*. A primary transfer bias voltage is applied to a primary transfer roller 53*a* from a power source for the primary transfer 531, by which the toner image is transferred onto the intermediary transfer belt 51 (primary transfer).

By the time the intermediary transfer belt 51 carrying the toner image of the magenta is conveyed to the image forming station Pb, the toner image of the cyan will be formed on the photosensitive drum 1*b* by the similar process, in the image forming station Pb. The cyan toner image is transferred on the magenta toner image on the intermediary transfer belt 51.

Similarly, when the toner image on the intermediary transfer belt 51 advances to the image forming station Pc, Pd, in the respective primary transfer portions, the yellow toner image and the black toner image are superimposedly transferred onto the toner image on the intermediary transfer belt 51.

On the other hand, as for the transfer material P taken out from the feeding cassette 8, the leading end thereof is once stopped at the registration roller 82. It adjusts the timing so that the toner image transferred superimposingly on the intermediary transfer belt 51 may be transferred onto the predetermined position of the transfer material P. The transfer material P fed at this adjusted timing from the registration roller 82 reaches the secondary transfer portion 58 where the opposing roller 56 and the secondary transfer roller 57 contact with each other interposing the intermediary transfer belt 51. The four color toner image is transferred all together onto the transfer material P by the secondary transfer bias voltage applied to the secondary transfer roller 57.

The transfer material P which now has the secondarily-transferred toner image is conveyed toward a fixing means 7 from the secondary transfer portion 58. By the fixing device 7, the toner image is fixed by the heat pressing on the transfer material. Since the surface of the fixing roller 71 is coated with the parting oil (silicone oil, for example) in order to enhance the parting property between the transfer material P and the fixing roller 71, this oil is deposited on the transfer material P. The transfer material P which now has the fixed toner image is discharged to an unshown a discharging tray disposed downstream of the fixing device 7. When the double-sided images are formed automatically, the transfer material is returned to the registration roller 82 in the state of the inversion in face orientation by way of an unshown transfer material reversing path. By repeating a series of processes of above described image formation, an image is formed also on the back side.

The feeding speed of the transfer material P in the fixing portion 78 of the fixing device 7 is lower than the feeding speed of the transfer material P in the secondary transfer portion 58. This is for preventing the disturbance of the image of the secondary transfer portion 58 by the impact by inrush of the transfer material P to the fixing portion 78. Furthermore, it is for, preventing the wrinkles of the transfer material P which may occur in the fixing portion 78 etc.

In the image forming apparatus 300 of the third embodiment, the optical sensors 123*a*, 123*b*, 123*c*, 123*d* which detect the densities of the toner images on the photosensitive drum 1*a*, 1*b*, 1*c*, 1*d* are provided. On the other hand, on the intermediary transfer belt 51, a pattern image detector 123*e* for sensing the toner images for the registration corrections of the image forming stations Pa, Pb, Pc, and Pd is provided. The reference density patterns of the colors are formed on the photosensitive drums 1*a*, 1*b*, 1*c*, 1*d*, respectively. The optical sensors 123*a*, 123*b*, 123*c*, 123*d* irradiate this reference density pattern with the detecting light, and they sense the reflected light therefrom. The controller 10 detects the densities of the reference density patterns about the respective colors based on the outputs of the optical sensors 123*a*, 123*b*, 123*c*, 123*d*. The toner supply amounts into the developing devices 4*a*, 4*b*, 4*c*, and 4*d* are adjusted, and the densities of the toner images are adjusted so that the densities of the detected reference density pattern may become the target values. By this, the density control for controlling the image density of the output image is carried out.

As shown in FIG. 9, the optical sensors 123*a*, 123*b*, 123*c*, 123*d* Are provided opposed to the photosensitive drums 1*a*, 1*b*, 1*c*, 1*d*, respectively, they irradiate the respective photosensitive drums 1*a*, 1*b*, 1*c*, 1*d* through the illumination windows 35 by LEDs 33 which are the light emitting portions. The reflected light therefrom is sensed through the light receiving window 36 by the photo-diode 34 which is the light receiving portion. When a density detecting toner image (patch) 32 passes the optical sensor 123*a*, 123*b*, 123*c*, 123*d*, a voltage signal corresponding to the density of a density detecting toner image 32 is outputted. Controller 10 (FIG. 1) senses this voltage signal, discriminates the density of the density detecting toner image 32, and controls the developing devices 4*a*, 4*b*, 4*c*, 4*d* in response to the result of discrimination.

As shown in FIG. 10, the pattern image detector 123*e* is positioned between the stretching roller 90 and the photosensitive drum 1*d* which is positioned downstream, with respect to advancing direction B of the intermediary transfer belt 51 among the plurality of photosensitive drums 1*a*, 1*b*, 1*c* and 1*d*. It reads the registration-correcting-pattern images formed on the intermediary transfer belt 51 by the image forming stations Pa, Pb, Pc, and Pd. The control for the registration correction is carried out on the basis of the result of detections of the pattern image detector 123*e* for the image forming stations Pa, Pb, Pc, and Pd.

As shown in FIG. 11, the registration-correcting-pattern image 62 is transferred onto the both lateral end portions of the intermediary transfer belt 51 in the primary transfer portion. The controller 10 controls image forming stations Pa-Pd shown in FIG. 8, and forms the registration-correcting-pattern images 62 on the intermediary transfer belt 51 at the predetermined timing. The controller 10 discriminates the registration deviations on the photosensitive drums 1*a*, 1*b*, 1*c*, 1*d* corresponding to the read results of the registration correcting pattern images 62 by the pattern image detector 123*e*. The controller 10 corrects electrically the image signals which should be recorded and it drives the folding mirrors provided in the optical path of the laser beams to correct the change of the optical path lengths or the optical path changes. The known methods can be used as to the detailed way and correcting method for amount of position deviations, and an example thereof of, is described for example, in Japanese Laid-open Patent Application Hei 01-142673.

The toner content can be sensed on the intermediary transfer belt 51.

In the third embodiment, the density detecting toner image 32 and the registration correcting pattern image 62 are formed on the inter-sheet space on the portion of the photosensitive drum 1*a*, 1*b*, 1*c*, 1*d* corresponding to the space between a transfer material and a following transfer material. By doing so, the image formation is effected, without reducing the productivity.

However, it is revealed that the image forming apparatus 300 shown in FIG. 1 involves the following problem. If the density of the toner image is sensed when the optical sensors 123*a*, 123*b*, 123*c*, 123*d* emit light, the potentials of the density detecting toner image 32 and the surface of the photosensitive drum 1*a*, 1*b*, 1*c*, 1*d* of the neighborhood thereof change. This is because the photosensitive drums 1*a*, 1*b*, 1*c*, 1*d* exhibit the photosensitivity relative to the wavelength of the light which the optical sensors 123*a*, 123*b*, 123*c*, 123*d* emit.

Particularly, in the case of the image forming apparatus 300 which employs the reverse development type, this problem is serious. The a charge potential Vd by the primary charger 2*a*, 2*b*, 2*c*, 2*d*, a surface potential Vdc under the density detecting toner image 32, and a light potential Vs of the illuminated portion of the density detecting toner image 32 may satisfy the relation of $|Vd|>|Vdc|>Vs|$.

Therefore, if transfer bias voltage is given to these regions, the potential after application of the transferring current changes as shown in FIG. 13, so that the polarity of the potential of the illuminated portion of the density detecting toner image 32 may be reverted. If the polarity reverts, the potential is not canceled in spite of the optical irradiation upstream of the primary transfer roller 53*a*, 53*b*, 53*c*, 53*d*. Therefore, the potential non-uniformity occurs in the portion in which the image is written. This image (the trace of the exposure by the optical sensor 123*a*, 123*b*, 123*c*, or 123*d*) appears as the so-called ghost image on the following image or the image formed after the one full turn of the photosensitive drum 1*a*, 1*b*, 1*c*, or 1*d*.

Furthermore, when the transferred registration-correcting-pattern image 62 is sensed on the intermediary transfer belt 51, this image should be faithfully transferred onto the intermediary transfer belt 51 from the photosensitive drum 1*a*, 1*b*, 1*c*, or 1*d*. For this reason, about the registration-correcting-pattern image 62 sensed on the intermediary transfer belt 51, it is desirable to apply transfer bias voltage similar to the transfer bias voltage, for the toner image transferred on the transfer material. When the recoverying bias voltage as the countermeasurement against the ghost is applied without damaging the productivity, it is desirable to always sense the resistance in the inter-sheet interval and to feed it back to the transfer bias voltage. By doing so, the proper transfer bias voltage, is applied relative to the toner image transferred on the transfer material.

The image forming apparatus 300 according to this embodiment comprises the optical sensors 123*a*, 123*b*, and 123*c*, 123*d* which sense the toner images optically on the photosensitive drums 1*a*, 1*b*, 1*c*, and 1*d* having the photosensitive layers as shown in FIG. 12. On the photosensitive drum 1*a*, 1*b*, 1*c*, 1*d*, the inter-sheet interval S exists between adjacent image forming regions P transferred onto a transfer material by bias voltage T1, T2, and T3. The controller 10 forms the density detecting toner image 32 on the inter-sheet interval S, and senses it by the optical sensor 123*a*, 123*b*, 123*c*, or 123*d*. At this time as shown in FIG. 9, LED33 which is the light emitting portion emits light onto the surface of the photosensitive drum 1*a*, 1*b*, 1*c*, or 1*d*. FIG. 12 shows the potential Vs of the portion 33E irradiated with light. In the transfer portion which is the position in which the image is transferred onto the intermediary transfer belt 51 from the photosensitive drum 1*a*, 1*b*, 1*c*, 1*d*, the potential of the portion which has the density detecting toner image 32, and the partial potential which does not have it are Vs1 and Vs2, respectively.

FIG. 13 shows the relation among the potentials Vs, Vs1, and Vs2. As typical values, the potential of the solid white portion which did not undertake the write-in exposure is −600V, and surface potential Vt of the photosensitive drum 1*a*, 1*b*, 1*c*, or 1*d* at the solid black portion having undertaken the write-in exposure and including the toner is −450V. The potential Vs1 of the portion which undertook the exposure by the optical sensor 123*a*, 123*b*, 123*c*, or 123*d* is −150V, and potential Vs2 is −50V.

In the image forming apparatus 300, the photosensitive drum 1*a*, 1*b*, 1*c*, 1*d* is charged to the negative polarity, and the toner of the negative polarity is deposited on the light portion of the latent image (reverse development type). The same applies to the case where the photosensitive drum is charged to the positive and the image formation is carried out with the toner having the polarity of the positive.

In the case of the image forming apparatus 300 of the third embodiment, the surface of the photosensitive drum 1*a*, 1*b*, 1*c*, or 1*d* is charged to the surface potential of Vd=−600V as shown in FIG. 14. The solid white portion comes to the transfer portion with approx. −600V in spite of some dark decays of the surface potential of the photosensitive drum 1*a*, 1*b*, 1*c*, 1*d*. The primary charging of the solid black portion is once carried out to Vd=−600V, and thereafter, it is exposed with light by the exposure device 3*a*, 3*b*, 3*c*, or 3*d*, and the surface potential thereof drops to V1=−200V. In the developing device 4*a*, 4*b*, 4*c*, or 4*d*, the negative toner is deposited with application of the voltage in the form of superimposed AC voltage and DC voltage on the developing sleeve. If the development efficiency is % 100 at this time, the surface of the photosensitive drum 1*a*, 1*b*, 1*c*, 1*d* is substantially charged with the toner to the potential of DC voltage of the developing bias voltage, and it is approx. Vt in the transfer portion.

On the other hand, about the density detecting toner image 32 which undertakes the exposure from the optical sensor 123*a*, 123*b*, 123*c*, or 123*d* after the development, absolute value of the potential thereof drops greatly. There are various density detecting toner images 32, and in the half-tone area which particularly has the large variation rate of the density (the change amount relative to actual density), light reaches from the gap between the toner and the toner on the surface of the photosensitive drum 1*a*, 1*b*, 1*c*, 1*d*. For this reason, the surface potential of the photosensitive drum 1*a*, 1*b*, 1*c*, 1*d* containing the toner which has approx. potential of Vt drops in absolute value to Vs2=−150V. In addition, when there is almost no toner, it drops in absolute value to Vs1=−50V.

In this state, a transfer bias voltage of the positive polarity is applied by the primary transfer roller 53*a*, 53*b*, 53*c*, or 53*d*. FIG. 13 shows the relation between the surface potential of the photosensitive drum 1*a*, 1*b*, 1*c*, 1*d* and the transferring current at this time. As shown in FIG. 13, the potential before entering the primary transfer roller 53*a*, 53*b*, 53*c*, or 53*d* is substantially the potential of the transferring current 0 μA. The surface potential of the photosensitive drum 1*a*, 1*b*, 1*c*, or 1*d* changes to the positive side by the transferring current which decreases with absolute value of this value. If the surface potential of the photosensitive drum 1*a*, 1*b*, 1*c*, or 1*d* reverts to the positive polarity, the surface potential of the photosensitive drum 1*a*, 1*b*, 1*c*, or 1*d* is not electrically discharged, even if the exposure is effected before the primary charging. For this reason, it appears as the ghost image at the time of the image formation of the following rotation of the photosensitive drum 1*a*, 1*b*, 1*c*, 1*d*, or remains as the image memory.

When the optical sensor 123*a*, 123*b*, 123*c*, 123*d* is for this reason, provided between the developing device 4*a*, 4*b*, 4*c*, 4*d* and the primary transfer roller 53*a*, 53*b*, 53*c*, 53*d*, it is desirable to provide the countermeasurement against the image memory. It is desirable to change transfer bias voltage between the portion exposed by the optical sensor 123*a*, 123*b*, 123*c*, 123*d* and the other portion.

However, the registration correcting pattern image 62 sensed on the intermediary transfer belt 51 is to transfer onto the intermediary transfer belt 51 from the photosensitive drum 1*a*, 1*b*, 1*c*, 1*d* by transfer bias voltage proper.

In view of this, the bias voltage is changed as shown in FIG. 15 in the third embodiment in response to the exposure timing by the optical sensor 123*a*, 123*b*, 123*c*, 123*d*. The recovering bias voltage T3 of the negative polarity is applied to the region S1 exposed by the optical sensor 123*a*, 123*b*, 123*c*, 123*d* in the inter-sheet space S2 between the image forming region P transferred onto the transfer material. Here, when the illumination area (the time of the irradiation) of the optical sensor 123*a*, 123*b*, 123*c*, 123*d* is larger (longer) than the density detecting toner image 32, the region irradiated with the solid white portion by the optical sensor 123*a*, 123*b*, 123*c*, 123*d* arises. By doing so, the portion which having the potential which dropped to the potential shown in FIG. 14 by Vs1 (typically −50V) is produced. In this case, in order to avoid the inversion to the positive polarity, the transferring current must be reduced from the current of FIG. 12 to 5 μA. When the illumination area (the time of the irradiation) of the optical sensor 123*a*, 123*b*, 123*c*, 123*d* at the time smaller (shorter) than the density detecting toner image 32, it drops to the potential Vs2 (typically −150V), and therefore, what is necessary is to reduce the transferring current to 15 μA.

The transfer bias voltage T2 required for the transferring to the intermediary transfer belt 51 from the photosensitive drum 1*a*, 1*b*, 1*c*, 1*d* is applied to the portion of the inter-sheet space S2 which has the registration correcting pattern image 62. The transfer bias voltage sufficient to transfer the color superimposedly T1 is applied to the image forming region P which is to be transferred onto the transfer material.

The determining method of such bias voltages T1, T2, T3 will be described. In the third embodiment, the bias voltage applied to the primary transfer roller 53*a*, 53*b*, 53*c*, 53*d* is controlled by the constant voltage control. The bias voltage is outputted to the primary transfer rollers 53*a*, 53*b*, 53*c*, 53*d* from an unshown transfer power sources, and they are provided for respective image forming stations Pa, Pb, Pc, Pd, and are controlled individually by the controller 10.

First, the three voltages V1, V2, V3 are applied at the time of the pre-rotation before entering the image forming operation as shown in FIG. 16. At this time, the photosensitive drum potential is charged to Vd1=−300V. The current which flows into the primary transfer roller 53*a*, 53*b*, 53*c*, 53*d* is detected at this time, and they are I1, I2, and I3. By doing so, the relation between the transferring current and the transferring voltage is known in the primary transfer roller 53*a*, 53*b*, 53*c*, 53*d*.

First About bias voltage T2, the current value It required to transfer the monochromatic toner image is beforehand determined by the experiment etc., and bias voltage T2' is determined from above described relation between the bias voltage and the transferring current. This is because the image formation of the registration correcting pattern image 62 is carried out monochromatically. The bias voltage T2' is that of the case where the potential of the photosensitive drum 1*a*, 1*b*, 1*c*, 1*d* is Vd1=−300V. The potential difference between the surface potential of the photosensitive drum 1*a*, 1*b*, 1*c*, 1*d* and the bias voltage applied to the primary transfer roller 53*a*, 53*b*, 53*c*, 53*d* at this time is as follows.

$$T2''=T2'+|Vd1|$$

This is called a transfer contrast. In order to feed the current, the potential difference T2" is required between the surface potential of the photosensitive drum 1*a*, 1*b*, 1*c*, 1*d*, and the primary transfer roller 53*a*, 53*b*, 53*c*, 53*d*. For this reason, at the time of the ordinary image formation, it is Vd=−600, and therefore, the following bias voltage T2 is applied.

$$T2=T2''-|Vd|$$

The bias voltage T3 applied to the toner image transferred onto the transfer material needs to be the sufficient to superimposedly transfer the secondary or higher order color unlike the case of the bias voltage T2. For this reason, it is desirable to offset the bias voltage supposing the toner layer being in the lower layer beforehand. This offset voltage is determined taking into consideration amount of charges of the toner, amount the maximum size appears and so on, and the bias voltage T3 is set as follows.

$$T3=T2+\Delta V$$

Where ΔV is determined by the maximum charge density of the toner and so on, (in this embodiment, in the normal temperature and normal humidity condition of 23° C., 50%, ΔV=1000V).

The bias T1 applied to the portion exposed by the optical sensor 123*a*, 123*b*, 123*c*, 123*d* is lower than above described bias voltage T2, T3. The current required in order to prevent the reversion of the surface potential of the photosensitive drum 1*a*, 1*b*, 1*c*, 1*d* in spite of the exposure to the LED33 (FIG. 9) of the solid white portion is set at 5 μA, and bias voltage T1' is determined on the basis of that. The transfer contrast T1 is determined similarly to the determination of the bias voltage T2.

$$T1''=T1'+|Vd1|$$

Transfer contrast T1" is adjusted relative to the potential of Vs1, and the transferring voltage T1 is determined.

$$T1=T1''-|Vs1|$$

In this embodiment, by above described method, T1=+1.0 Kv, T2=+2.5 Kv $$T3=+3.5\text{ Kv}$$

Current value Ilim of which the polarity of the surface potential of the photosensitive drum 1*a*, 1*b*, 1*c*, 1*d* does not revert may be determined as follows.

A dielectric constant of the surface layer of the photosensitive drum 1*a*, 1*b*, 1*c*, 1*d* is εr, a vacuum transmissivity is ε0, and a film thickness from the drum grounding to the surface layer is d. A potential after the exposure by the optical sensor 123*a*, 123*b*, 123*c*, 123*d* is Vs, a process speed is Vp (peripheral speed of the photosensitive drum 1), and a thrust length of the primary transfer roller 53*a*, 53*b*, 53*c*, 53*d* is L. The surface potential of the region exposed by the optical sensor 123*a*, 123*b*, 123*c*, 123*d* is Vs, and the current which flows through the exposed region is Ilim. The following relation is satisfied among them.

$$|Ilim|<=\epsilon 0\times\epsilon r\times Vp\times S\times|Vs|/d.$$

Therefore, Ilim may be determined from this formula. The potential Vs can also be determined experimentally, and, it can also be determined by changing transfer bias voltage in the exposed area by the optical sensor 123*a*, 123*b*, 123*c*, 123*d* and by determining the relation between the voltage and the current.

In this embodiment, εr=3, d=26 μm, and Vp=300 mm/s, L=332 mm.

The above-stated example shows it is satisfactory that without the inter-sheet interval, the transferring current in the exposed area by the optical sensor 123*a*, 123*b*, 123*c*, 123*d* is below Ilim. Therefore, alternatively, the current of the direction opposite to the current fed relative to the image which transfer bias voltage forms on the normal transfer material may be fed, in other words, the recoverying bias voltage having the polarity opposite to that of transfer bias voltage may be applied.

As described above, the image forming apparatus 300 which detects the density detecting toner image 32 on the photosensitive drum 1*a*, 1*b*, 1*c*, 1*d* having the photosensitive layer by the optical sensor 123*a*, 123*b*, 123*c*, 123*d* is provided. In the image forming apparatus 300 of the reverse development type, the electric optical image memory and ghost of the photosensitive drums 1*a*, 1*b*, 1*c*, and 1*d* are prevented, the density and the registration are stabilized, and the high image quality can be provided.

Fourth Embodiment

Figure 17:
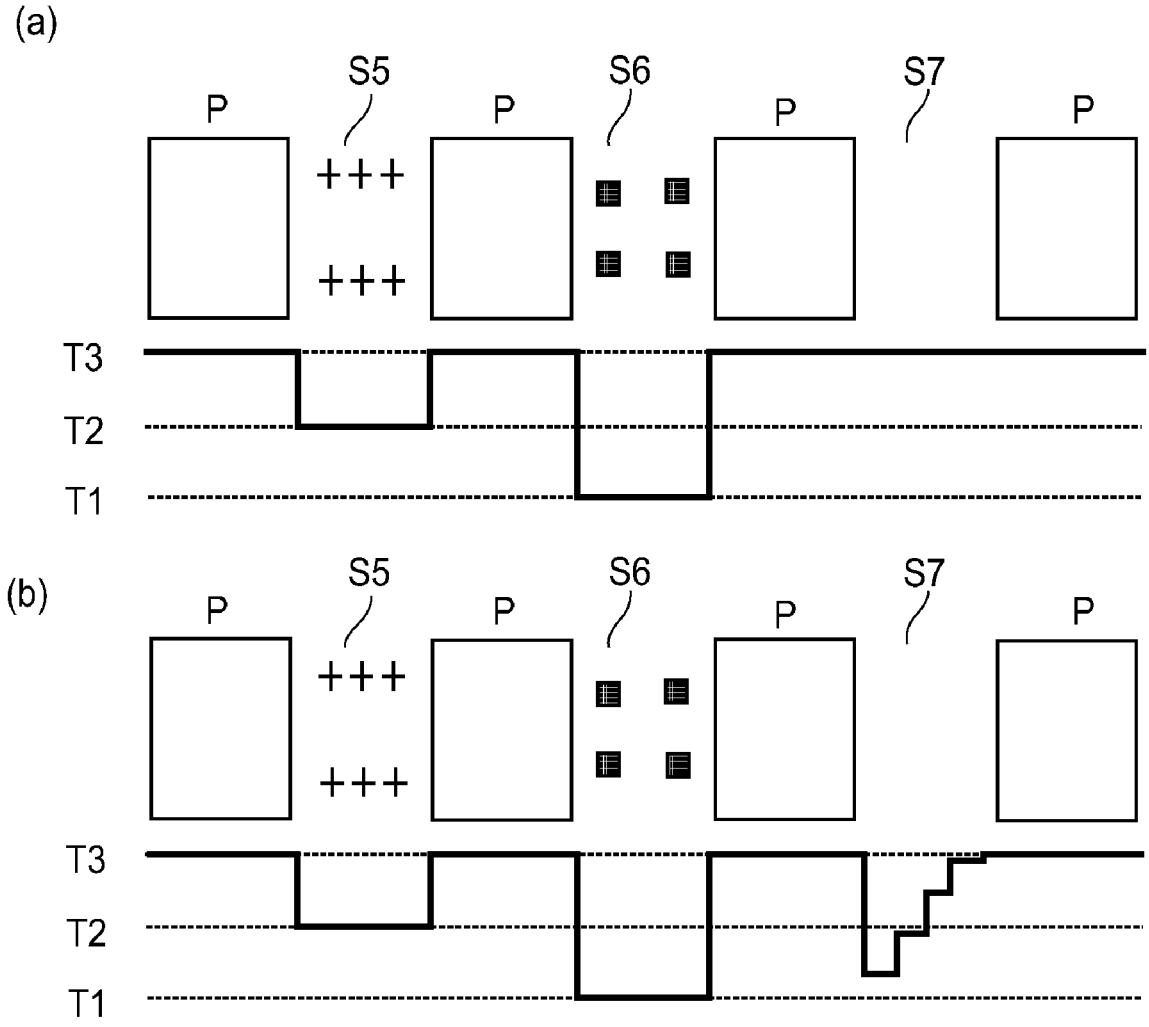
FIG. 17 is an illustration of the bias armature-voltage control in the inter-sheet interval in a fourth embodiment.

FIG. 17 is the illustration of the bias voltage control in the inter-sheet interval in the fourth embodiment. The fundamental structure of the image forming apparatus of the fourth embodiment is the same as that of the third embodiment, and therefore, the detailed description thereof is omitted.

In the fourth embodiment, the bias voltages which are different for the inter-sheet intervals in the continuous image formation are applied. There are three types as follows as shown in FIG. 17:

(1) Inter-sheet interval S6 for forming the density detecting toner image 32 on the photosensitive drum 1*a*, 1*b*, 1*c*, or 1*d*

(2) Inter-sheet interval S5 for forming the toner image which undertakes the toner content detection on the intermediary transfer belt 51 and the registration correcting pattern image 62

(3) Inter-sheet interval S7 for detecting the impedances of the primary transfer roller 53*a*, 53*b*, 53*c*, 53*d*, the intermediary transfer belt 51, the photosensitive drum 1*a*, 1*b*, 1*c*, 1*d* and so on.

In these inter-sheet intervals S5, S6, S7, the control shown in (a) and (b) of FIG. 17 is carried out.

In the inter-sheet interval S6 of (1), the bias T1 applied to the portion exposed by the optical sensor 123*a*, 123*b*, 123*c*, 123*d* is applied to the primary transfer roller 53*a*, 53*b*, 53*c*, 53*d*.

In the inter-sheet interval S5 of (2), the bias voltage T2 required in order to transfer primarily the registration correcting pattern image 62 onto the intermediary transfer belt 51 from the photosensitive drum 1*a*, 1*b*, 1*c*, 1*d* is applied.

In the inter-sheet interval S7 of (3), application of, the bias voltage T3 applied to the toner image transferred onto the transfer material as shown in (a) of FIG. 17 is continued. Or, the bias voltages are applied in two or more stages up to the bias voltage T3 as shown in (a) of FIG. 17.

The bias voltages T1, T2, T3 are set similarly to the third embodiment stated above. However, in the fourth embodiment, when the inter-sheet interval S7 of (3) passes the primary transfer roller 53*a*, 53*b*, 53*c*, 53*d*, the current value which flows between the primary transfer roller 53*a*, 53*b*, 53*c*, 53*d* and the intermediary transfer belt 51 is monitored. The result of monitoring is fed back to the setting of the bias voltage T3 or the bias voltage T1, T2.

Although the description is made about a plurality of inter-sheet intervals S5, S6, S7 in the fourth embodiment, the regions of (1), (2), and (3) may exist all together in a single inter-sheet interval.

In applying the bias voltage T2 in the region of (2), the current value which flows between the primary transfer roller 53*a*, 53*b*, 53*c*, 53*d* and the intermediary transfer belt 51 may be monitored. By doing so, the transferring current value may be fed back to the bias voltage T1, T2, T3.

As has been described hereinbefore, with the fourth embodiment, the transferring current relative to the voltage applied to the primary transfer roller 53*a*, 53*b*, 53*c*, 53*d* is monitored in the inter-sheet interval. By doing so, the effects similar to the third embodiment are provided without reducing the productivity.

Fifth Embodiment

Figure 18:
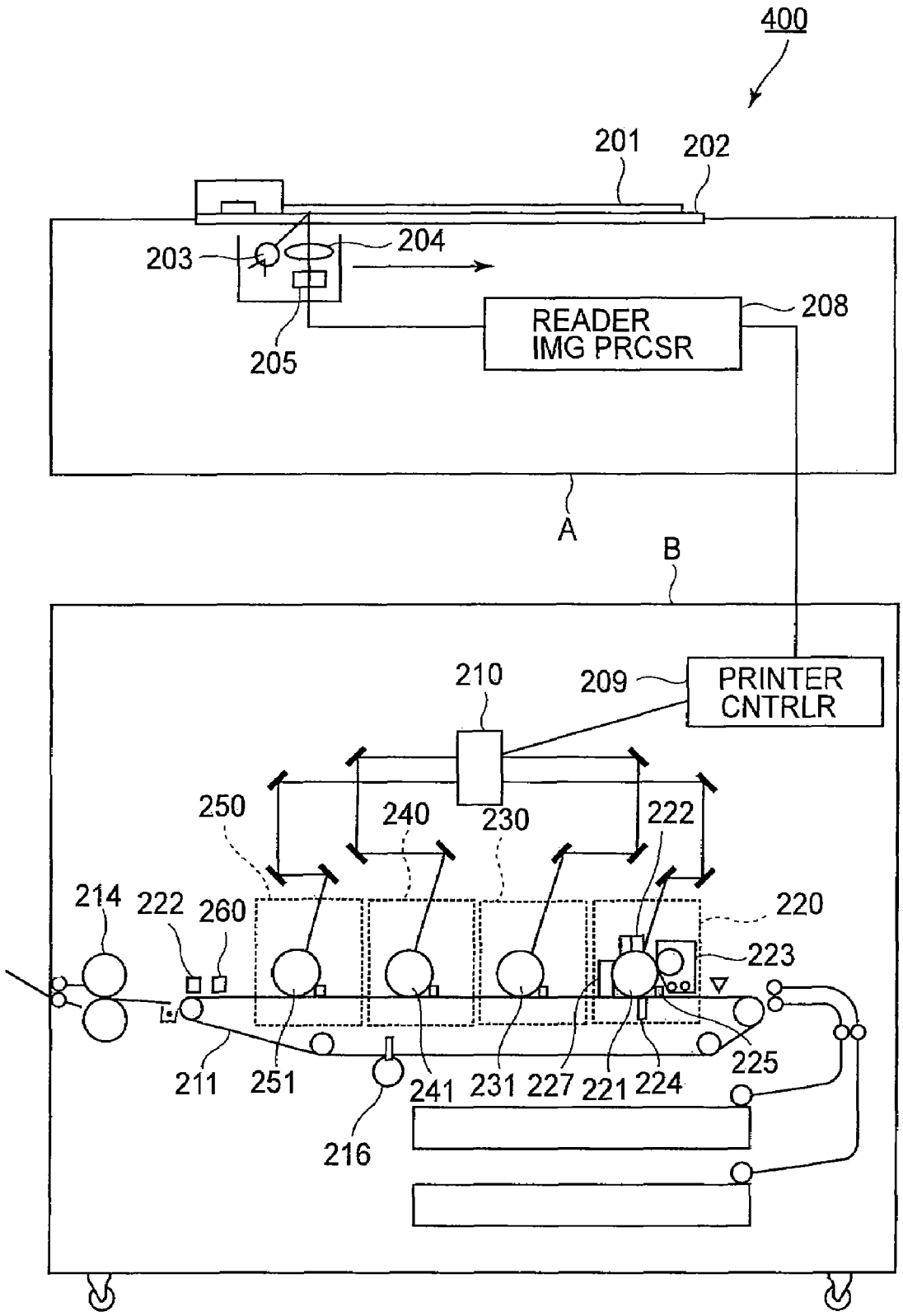
FIG. 18 is a sectional view which illustrates a general arrangement of an image forming apparatus of a fifth embodiment.

FIG. 18 is the sectional view which illustrates the schematic structure of the image forming apparatus of the fifth embodiment. In the fifth embodiment, the portion corresponding to the intermediary transfer belt 51 in the third and the fourth embodiment is a transferring-feeding belt 211. The inter-sheet intervals of the following 3 kinds are provided also in the fifth embodiment, thereby to provide the effects similar to the fourth embodiment.

(1) The inter-sheet interval for forming the density detecting toner image to be sensed by the optical sensor 225 on the photosensitive drum 221

(2) The inter-sheet interval for forming the toner image which undertakes the toner content detection and the registration detection on the transfer material conveying belt 211

(3) The inter-sheet interval for sensing the impedances of the transfer member 224, the transfer material conveying belt 211, the photosensitive drum 221 and so on.

As shown in FIG. 18, the image forming apparatus 400 of the fifth embodiment comprises a reader A for reading an image of an original, and a printer station B for forming an image on a transfer material. In the reader A, an original disposed between an original supporting platen glass 202 and an original covering plate 201 is illuminated by an illuminator 203, and it is projected on the reading element 205 by the optical system 204. The illuminator 203, the optical system 204, and the reading element are integral, and are moved in the direction indicated by arrow for scanning. The reader image processor 208 incorporates the output of the reading element 205 resulting from the scanning, forms the image data of the original, and generates the density data for every separated color.

The printer station B is provided with four stations 220, 230, 240, 250 corresponding to the four separated colors. The stations 220, 230, 240, 250 form the toner images for every separated colors using the photosensitive drums 221, 231, 241, 251, respectively. Although the stations 220, 230, 240, 250 differ only in the developing color, others are constituted identically, and therefore, the description is omitted as to the stations other than the station 220.

The printer controller 209 converts the density data for every separated color received from the reader image processor 208 to the scanning line image data, and operates the exposure device 210. The outer surface of the photosensitive drum 221 is charged to the uniform potential using, and the electrostatic image is formed when the exposure device 210 carries out the writing by the exposure. The electrostatic image is developed into the toner image with the toner by the developing device 223. The toner image carried by the photosensitive drum 221 is transferred onto the transfer material carried on the transfer material conveying belt 211 by applying transfer bias voltage to the transfer member 224. The transfer material is conveyed to the transfer material conveying belt 211 and the color toner images are superimposedly transferred thereon from the photosensitive drums 221, 231, 241, 251. The transfer material carrying the four color toner image is fed to the fixing device 214, so that the toner image is fixed by the heating and the pressing. The photosensitive drum 221 is cleaned by the cleaning device 227 after the toner image is transferred, so that the untransferred toner is removed from it. The transfer material conveying belt 211 is cleaned by the cleaning device 216 after conveying the transfer material.

An optical sensor 225 which detects the density detecting toner image formed on the photosensitive drum 221 is provided between the developing device 223 and the transfer member 224. Similarly to the fourth embodiment, the optical sensor 225 irradiates the density detecting toner image with light LED, and detects reflection luminous intensity therefrom, and therefore, a trace of exposure is produced by the photosensitive drum 221.

A pattern image detector 260 and a density detecting sensor 222 are provided downstream of the photosensitive drum 251. The pattern image detector 260 reads the registration-correcting-pattern images which are formed on the photosensitive drums 221, 231, 241, 251, respectively, and which are transferred on the transfer material conveying belt 211. Additional density detecting sensors 222 detect the toner images which are formed on the photosensitive drums 221, 231, 241, 251, respectively, and which are transferred onto the transfer material conveying belt 211. For simplicity of illustration, only one other density detecting sensor 222 is shown in FIG. 18 in connection with photosensitive drum 221. However, similar density detecting sensors are also provided for photosensitive drums 231, 241, and 251.

Therefore similarly to the fourth embodiment, as for the registration-correcting-pattern image detected by the pattern image detector 260, it is desirable to transfer it onto the transfer material conveying belt 211 by the proper bias voltage. The same applies also to the toner image detected by the density detecting sensor 222.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 115049/2006 filed Apr. 18, 2006 which is hereby incorporated by reference.

What is claimed is:

1. An image forming apparatus comprising:

a rotatable image bearing member having a photosensitive layer;

toner image forming means for forming a toner image on said image bearing member, said toner image forming means being capable of forming a detection toner image on a part of said image bearing member along a direction in which the rotational axis of said image bearing member extends;

detecting means for optically detecting the detection toner image formed on said image bearing member;

control means for controlling a toner image forming condition of said toner image forming means on the basis of a result of detection of said detecting means;

a transfer member for electrostatically transferring a toner image from said image bearing member onto a transfer material at a transfer region; and voltage applying means for applying to said transfer member when said detection toner image passes the transfer region, a predetermined voltage which has the same polarity as a charge polarity of toner and which is such a voltage that the potential difference between said transfer member and said image bearing member in an area of said image bearing member for the formation of the detection toner image after passing said detecting means and before reaching the transfer region is not less than a discharge threshold and that the potential difference between said transfer member and said image bearing member in an area of said image bearing member outside the area for formation of the detection toner image is less than the discharge threshold.

2. An apparatus according to claim 1, wherein said toner image forming means includes a developing portion for developing an electrostatic latent image formed on said rotatable image bearing member, and said detecting means is disposed upstream of the transfer region and downstream of the developing portion with respect to a rotational direction of said rotatable image bearing member.

3. An apparatus according to claim 1, wherein said toner image forming means includes a charging portion for charging said rotatable image bearing member, wherein a potential difference between the predetermined voltage and a potential of a region of said rotatable image bearing member charged by the charging portion is less than a discharge threshold, and a potential difference between the predetermined voltage and a potential of a region of said image bearing member where the detection toner image is exposed to said detecting means is not less than the discharge threshold.

4. An apparatus according to claim 1, further comprising an ambient condition detecting means for detecting an ambient temperature or an ambient humidity, wherein the predetermined voltage is changed in accordance with an output of said ambient condition detecting means.

5. An apparatus according to claim 1, wherein said detecting means includes an exposure portion for illuminating the detection toner image with light, wherein the predetermined voltage is changed in accordance with a light intensity supplied by the exposure portion.

6. An apparatus according to claim 1, further comprising an exposure device, disposed downstream of the transfer region, for electrically discharging said rotatable image bearing member.

7. An apparatus according to claim 1, wherein the transfer material includes an intermediary transfer member for carrying a toner image transferred from said rotatable image bearing member.

8. An image forming apparatus comprising:

a rotatable image bearing member having a photosensitive layer;

toner image forming means for forming a toner image on said rotatable image bearing member, said toner image forming means being capable of forming, on said rotatable image bearing member, a first detection toner image and a second detection toner image which are not to be formed on a recording material;

a rotatable belt member in contact with said rotatable image bearing member;

a transfer member for electrostatically transferring a toner image from said rotatable image bearing member onto said rotatable belt member at a transfer region;

first detecting means, disposed upstream of the transfer region, for optically detecting the first detection toner image formed on said rotatable image bearing member;

second detecting means for optically detecting the second detection toner image transferred onto said rotatable belt member;

control means for controlling a toner image forming condition of said toner image forming means on the basis of a result of detection of at least one of said first and second detecting means; and voltage applying means for applying a voltage to said transfer member, wherein an absolute value of a voltage of a polarity opposite to the toner image which is applied to said transfer member when the first detection toner image detected by said first detecting means passes the transfer region, is smaller than an absolute value of a voltage of the opposite polarity which is applied to said transfer member when the second detection toner image passes the transfer region.

* * * * *